US007015391B2

(12) United States Patent
Tomoda

(10) Patent No.: US 7,015,391 B2
(45) Date of Patent: Mar. 21, 2006

(54) ANALOG ELECTRONIC DRUM SET, PARTS FOR DRUM STICK, ANALOG ELECTRONIC DRUM SET AND FOOT-PEDAL UNIT

(75) Inventor: Shingo Tomoda, 190-5, Uratakaomachi, Hachiouji-shi, Tokyo 193-0841 (JP)

(73) Assignee: Shingo Tomoda, Tokyo (JP)

( * ) Notice: Subject to any disclaimer, the term of this patent is extended or adjusted under 35 U.S.C. 154(b) by 50 days.

(21) Appl. No.: 10/383,699

(22) Filed: Mar. 7, 2003

(65) Prior Publication Data

US 2003/0221545 A1 Dec. 4, 2003

Related U.S. Application Data

(63) Continuation of application No. PCT/JP01/07682, filed on Sep. 5, 2001, and a continuation of application No. PCT/JP01/03135, filed on Apr. 11, 2001.

(30) Foreign Application Priority Data

Sep. 7, 2000 (JP) ..... 2000-271954

(51) Int. Cl.
*G10H 3/18* (2006.01)

(52) U.S. Cl. ..... 84/726

(58) Field of Classification Search ..... 84/725, 84/726

See application file for complete search history.

(56) References Cited

U.S. PATENT DOCUMENTS

| | | | | | |
|---|---|---|---|---|---|
| 3,509,264 | A | * | 4/1970 | Green | 84/725 |
| 3,743,751 | A | * | 7/1973 | Ibanez | 84/741 |
| 3,956,959 | A | * | 5/1976 | Ebihara et al. | 84/725 |
| 4,168,646 | A | * | 9/1979 | May | 84/723 |
| 4,242,937 | A | * | 1/1981 | Pozar | 84/725 |
| 4,570,522 | A | * | 2/1986 | May | 84/723 |
| 4,819,536 | A | * | 4/1989 | Lombardi | 84/746 |
| 5,105,711 | A | * | 4/1992 | Barnard | 84/744 |
| 5,633,473 | A | * | 5/1997 | Mori et al. | 84/625 |
| 6,075,197 | A | * | 6/2000 | Chan | 84/730 |
| 6,121,528 | A | * | 9/2000 | May | 84/411 R |

FOREIGN PATENT DOCUMENTS

| | | | |
|---|---|---|---|
| JP | 48-7455 | B | 3/1973 |
| JP | 63-44234 | B | 9/1988 |
| JP | 7-295561 | A | 11/1995 |
| JP | 7-311577 | A | 11/1995 |
| JP | 8-44357 | A | 2/1996 |
| JP | 8-248949 | A | 9/1996 |
| JP | 11-030983 | A | 2/1999 |
| JP | 11-237877 | A | 8/1999 |
| JP | 2601905 | Y | 12/1999 |

* cited by examiner

*Primary Examiner*—Jeffrey W Donels
(74) *Attorney, Agent, or Firm*—Alan D. Kamrath; Nikolai & Mersereau, P.A.

(57) ABSTRACT

Beating sounds and attenuation sounds generated by first original sound generators (100) corresponding to elements of a conventional drum set are received by augmented microphones. A sound modulator (26) is used for modulating tones of the electronic sounds from the augmented microphones without any digital conversion. A reproducer (34) is used for reproducing the output sounds from the sound modulator (26). Because the processes of digitally converting, transferring signals by optical couplers, and selecting recorded sounds for reproducing are eliminated, the reproduced sounds can represent subtle techniques of the performer by directly using the original sounds generated when the first original sound generators (100) are beaten.

12 Claims, 37 Drawing Sheets

ANALOG ELECTRONIC DRUM SET, PARTS FOR DRUM STICK, ANALOG ELECTRONIC DRUM SET AND FOOT-PEDAL UNIT

CROSS REFERENCE

This application is a continuation of PCT International Appln. No. PCT/JP01/07682 filed Sep. 5, 2001 and PCT International Appln. No. PCT/JP01/03135 filed Apr. 11, 2001.

BACKGROUND OF THE INVENTION

1. Field of the Invention

The present invention is related to an analog electronic drum set, and parts for drum stick, analog electronic drum set, and more particularly to an analog electronic drum set that electronically processes various beating sounds generated by elements of a drum set to reproduce the sounds, without any digital conversion, and its elements.

2. Description of Related Art

Electronic musical instruments, such as an electronic organ developed in 1800s, have been well known, and these electronic musical instruments have been developed in various aspects since then. Elements about drum sets also have developed with the tendency. Earlier, a plan of "drum synthesizer" was brought forward. The drum synthesizer is a means that reproduces drumbeats by an electronic acoustics synthesizer, according to and based on beating sounds from a pad as a receiver beaten by a performer.

Afterwards, because digital electronic acoustics synthesizers are presented, other plans, such as "virtual drum" and "MIDI drum", that reproduce drumbeats by the digital electronic acoustics synthesizers, based on recorded drumbeats have been brought forward, as well-known electronic drums.

FIG. 28 illustrates an essential structure of the electronic drum as described above. As shown in FIG. 28, when a performer beats a pad (10) made of rubber or resin, beats are converted into electronic signals to output. The output electronic signals are transmitted in a MIDI (musical instrument digital interface) converter (12).

The conventional MIDI, which is connected to an electronic instrument and a computer for producing musical data, and it is not a information on the sound itself, but an information like height, volume, length, tone and effect, which can changed into "a digital data" to represent music.

By the MIDI converter (12), the electronic signals corresponding to the beating on the pad (10) can be converted into MIDI signals. The MIDI signals are transmitted into a sonic source (16) by an optical coupler (14). According to the MIDI signals, the sonic source (16), which has various sounds previously recorded therein, selects and outputs sounds corresponding to the MIDI signals. The sonic source (16) not only records sounds of various musical instruments, but also various sound effects such as sounds of engines. Namely, in this electronic musical instrument, after the sound signals are digitally converted, the reproduced tones are completely independent of the tones of beating on the pad.

The sound signals output from the MIDI converter (12) are processed a series of modulations by an effecter (18), and transmitted into a reproducer (20). By using a low sound reproducer, such as a headphone, the electronic musical instrument may not output a loud sound, thus avoiding disturbance to others.

After beatings on the pad (10) are digitized, namely converted into digital data, the electronic drum set can reproduce various sounds.

The electronic rum set often uses a pressure sensor as a piezoelectricity component. When the pad is beaten, voltages generated by deformations of the pressure sensor are converted into digital signals by the MIDI converter (12) to reproduce desired sounds.

Namely, instantaneous deformations and deformation amounts of the pressure sensor when beaten are selected. For excluding the beating sounds from the reproduced sounds, the beating sounds should be eliminated. In this way, factors of beating sounds including pitch, attenuation, and tone will not be reflected at all. Therefore, by using the electronic drum set, beating actions can by an electronic manner reproduce not only sounds of drumbeats, but also sounds of other musical instruments such as pianos, clavicembalos and brasses, and even other sounds in nature.

Technologies about MIDI converters to convert signals by using deformations of a pressure strike sensor as a piezoelectricity component, as described above, and technologies of drum synthesizer described hereinafter have been disclosed in JP publication No 12177, 1978, JP publication No. 29516, 1986, JP publication No. 149254, 1995, JP publication No. 311577, 1996, JP publication No. 44357, 1997, and JP patent No. 2601905.

A brief explanation about a principle of the drum synthesizer without a MIDI will now be described. At first, beating actions generate electronic signals to turn a switch on. A device called VCO (Voltage Controlled Oscillater) receives the electronic signals and then reproduces sounds, based on a wave selected from types including impulse wave, sine wave, and tooth wave.

The reproduce sounds are transmitted into a device called VCF (Voltage Controlled Filter) to modulate the sounds for improving brightness and rising tone. Afterwards, the sounds are transmitted into a device called VCA (Voltage Controlled Amplifier) for adding tremolos and volume adjustment. Finally, the sounds are transmitted into an EG (Envelope Generator) to set up a start time, a delay time, a lasting time, and a releasing time, namely, to set up the time of the sound beginning, the time from the maximum sound to the lasting sound, the extending time, and the aftersound retaining time etc. Through further functional processes, such as changing additional diapasons of the sounds, the sound can be output from output ends.

For simplicity of description hereinafter, a conventional drum set is illustrated in FIG. 29. The drum group includes a snare drum indicated by the numeral 1, a first tom-tom indicated by the numeral 2, a second tom-tom indicated by the numeral 3, an auxiliary tom-tom indicated by the numeral 5, a bass drum indicated by the numeral 6, and a pedal for the bass drum indicated by the numeral 7. The cymbal group includes a hi-hat cymbal indicated by the numeral 8, a first cymbal indicated by the numeral 9, a second cymbal indicated by the numeral 10, and a foot pedal for operating the hi-hat cymbal indicated by the numeral 11.

In addition, it should be understood that the "conventional drum set" mentioned in context will not be limited in the drum set shown in FIG. 29.

The "conventional drum set" may include only the drum group, or only the cymbal group, and/or other elements excluding the drum group and the cymbal group. Namely, the conventional drum set may include at least one of the drum group and the cymbal group.

Moreover, the "conventional drum set" mentioned in context does not need amplifiers or speakers for electronic processing, and is only beaten to produce sounds in itself for performance. Therefore, in some wide locations, those amplifiers and speakers to amplify sound are only used for outputting the drumbeats directly generated in the drum set. Therefore, the "conventional drum set" means a device that can directly produce drumbeats without any electronic processing.

In addition, a drum group can include some elements of the drum group shown in FIG. 29, ore any drum elements not shown in FIG. 29.

Similarly, a cymbal group can also include some elements of the cymbal group shown in FIG. 29, or other cymbal elements not shown in FIG. 29.

When the electronic drum set is used, because the reproduced sound is independent to the sounds of beating the pad, the beating can reproduce sounds like conventional drumbeats, cries of animals and engine sounds, etc.

When the head phone is used, there is only the sound of beating the pad made of rubber and resin in the environment, so that an exerciser can perform with the drum set without disturbing others.

Because the pad to convert beats into electronic signals is made of resilient rubber and the like, it is difficult to respond to some slight beats. On the other hand, if the pad is made of some hard materials for detecting these slight beats, the performer may be injured through the continual impacts. Therefore, only beats with a certain strength on the known pad can generate reproduced electronic signals.

For the conventional drum set, a skilled performer can produce subtle distinctions in drumbeats by using various techniques, such as tightly or loosely gripping the sticks, or changing times of the sticks in contact with the beaten parts.

However, the known electronic drum set can not reflect the subtle distinctions at all, even if the performer uses these techniques.

Furthermore, there is a time difference from beating pad to generate librations, converting the librations into the MIDI signals, transmitting the MIDI signals into the sonic source through the optical coupler, and reproducing the sounds recorded in the sonic source according to the digital signals. Namely, there is a time difference between the beat action by the performer and the sounds reproduced from the reproducer, so the MIDI drum set does not satisfy those skilled performers.

In addition, although without MIDI, the drum synthesizer also does not use drumbeats generated at first to reproduce sounds. Namely, the drumbeats are only used for turning on the switch. Thus, the drum synthesizer also has the problem that can not represent the subtle distinctions in various techniques used by the skilled performer, and only can output electronic sounds produced and recorded previously.

In view of these problems as described above, the invention provides an analog electronic drum set and elements for the analog electronic drum set which can reproduce drumbeats to represent subtle distinctions in beating techniques of a performer, and can eliminate the time difference between the beat action and the reproduced sound.

SUMMARY OF THE INVENTION

For achieving the objective as described above, configured as a conventional drum set, the analog electronic drum set includes a first original sound generator with a batter head without a resonator, a microphone for electrically augmenting beating sounds and attenuation sounds generated by the first original sound generator, a sound modulator for modulating tones of the electronic sounds from the microphone without any digital conversion, and a reproducer for reproducing the output sounds from the sound modulator.

The first original sound generator without the resonator can generate sounds with a volume lower than a conventional drum set. Therefore, when the first original sound generator is beaten, the volume of the sound is lower than the actual volume of sounds generated by a conventional drum set.

The beating sounds and attenuation sounds of the first original sound generator are received and amplified by augmented microphones to become electronic sounds. The tones of the electronic sounds are modulated by the sound modulator. The tone modulation is a process of electronic simulation based on the sound signals from the microphone without any digital conversion. Thereafter, the sound are reproduced by an amplifier and a headphone.

By this means, the processes of digitally converting, transferring signals by optical couplers, and selecting recorded sounds for reproducing are eliminated, so that there is no time different between the beating actions of the performer and the reproduced sounds.

Furthermore, not similar to the conventional electronic drum set of which the reproduced sounds are independent from the actual sounds of beating the pad, the actual beating sounds and attenuation sounds of the first original sound generator are directly used, so that subtle beating techniques of the performer can be represented in the reproduced sounds. Namely, the sounds according to various performing techniques including holding the stick, beating manners, and rubbing, as used in the conventional drum set, can be reproduced and represented, The sound modulator is composed of a primary effecter, including input terminals, an equalizer, a tuner and a compressor, and an auxiliary effecter, including echo, chorus, delay, and ambient. Thus, without any digital conversion, the sound modulator can amplify the sound, intensify the tones, modulate the diapasons and pressures of the sounds. Therefore, the low volume of the sounds generated by the first original sound generator can be amplified to approximate to an actual volume of a conventional drum set and the sounds can be reproduced with tone colors and pressures.

According to the present invention, the first original sound generators are made of materials which can generate sounds approximate to the actual sounds of the respective conventional elements. With these materials, it is easy to modulate the tones of the sounds by the sound modulator. Namely, it is easy to intensify the parts in the sounds approximate to the tones of the conventional drum set.

A drum element for the analog electronic drum set, as a drum element of a conventional drum set, includes a first original sound generator with a batter head but without a resonator, and a microphone for electrically augmenting beating sounds and attenuation sounds generated by the first original sound generator.

The drum elements include a bass drum element, a snare drum element, and tom-tom element. Because the first original sound generators without resonators have small diameters, a slim stick can be used to generate the sounds lower than the conventional drum set. Therefore, the analog electronic drum set can be used in a site without a sound arrester.

According to an embodiment of the invention, the batter heads are made of materials with metal components, and the microphones are mounted on the batter head by a magnetic force.

Thus, the microphones are directly mounted on the batter heads made of the material with metal components, and not only will not receive noises, but also can receive good original sounds for modulating.

Another drum element for the analog electronic drum set, as a conventional bass drum; includes a first original sound generator with a batter head, which can be directly beaten by a foot, but without resonator, and a microphone for electrically augmenting beating sounds and attenuation sounds generated by the first original sound generator.

The conventional bass drum is performed by using a pedal. Namely, when the pedal is stepped on, a drumstick is rotated to beat a batter head substantially perpendicular to the ground.

According to the present invention, the bass drum element is provided with a batter head which can be directly beaten by a foot. Thus, the bass drum element can be performed by a slight beating action without stepping on the pedal.

A pedal assembly, used for the bass drum element for the analog electronic drum set, includes a pulley with a potential to rotate towards a predetermined direction, a pedal which can be stepped downwards against the potential to rotate the pulley, and a drumstick mounted on the pulley at a side the same as the pedal, which can be turned to the front and down along with the pulley to beat the batter head. Furthermore, the pedal assembly can also be provided with two pulleys mounted side by side and rotated synchronously.

The microphone can be an augmented microphone which can electrically amplify vibrations of a magnetic substance. The batter head is provided with a vibration source made of a magnetic substance to correspond to the augmented microphone and which can vibrate along with the batter head. The augmented microphone can be used for amplifying the vibrations of the vibration source.

The vibration source can be adhered on an inner surface of the batter head, or abutted the inner surface of the batter head under a pressure. A distance of the augmented microphone to the vibration source is adjustable.

In addition, the microphone is an augmented microphone which can electrically amplify vibrations of a magnetic substance, and the batter head is made of a material with magnetic components. Thus, the augmented microphone can be used for amplifying the vibrations of the vibration source. A distance of the augmented microphone to the battler head is adjustable.

An element for an analog electronic drum set, as a cymbal element of a conventional drum set, includes a first original sound generator made of a metal and formed with a tubular body with two open ends, and a microphone for electrically augmenting beating sounds and attenuation sounds generated by the first original sound generator.

The conventional cymbal will generate a loud sound. The cymbal element as described above will generate low sounds and can be used in a site without a sound arrester. Moreover, by the hollow body, beating the cymbal element can generate a nice original sound. The first original sound generator can be formed as a metal disk, which generates sounds lower than that of the conventional cymbals.

In this situation, the microphone is an augmented microphone which can electrically amplify vibrations of a magnetic substance. The first original sound generator can be made of a metal with magnetic components. Thus, the augmented microphone can be used for amplifying the vibrations of the first original sound generator. A distance of the augmented microphone to the first original sound generator is adjustable.

The augmented microphone is also applicable to the conventional drum set to provide a large volume of sound for audiences.

The analog electronic drum set of the invention as described above is further provided with a sound modulator for modulating tones of the electronic sounds from the microphone without any digital conversion, and a reproducer for reproducing the output sounds from the sound modulator.

Therefore, by using the elements as described above, the low sounds generated by the sound sources can be reproduced and modulated by the sound modulator without any digital conversion, so that there is no time difference between the beating actions and the reproduced sounds.

Furthermore, by directly using the beating sounds as the original sounds, the reproduced sound can represent the subtle techniques of the performer.

DETAILED DESCRIPTION OF THE PREFERRED EMBODIMENT

Figure 1:
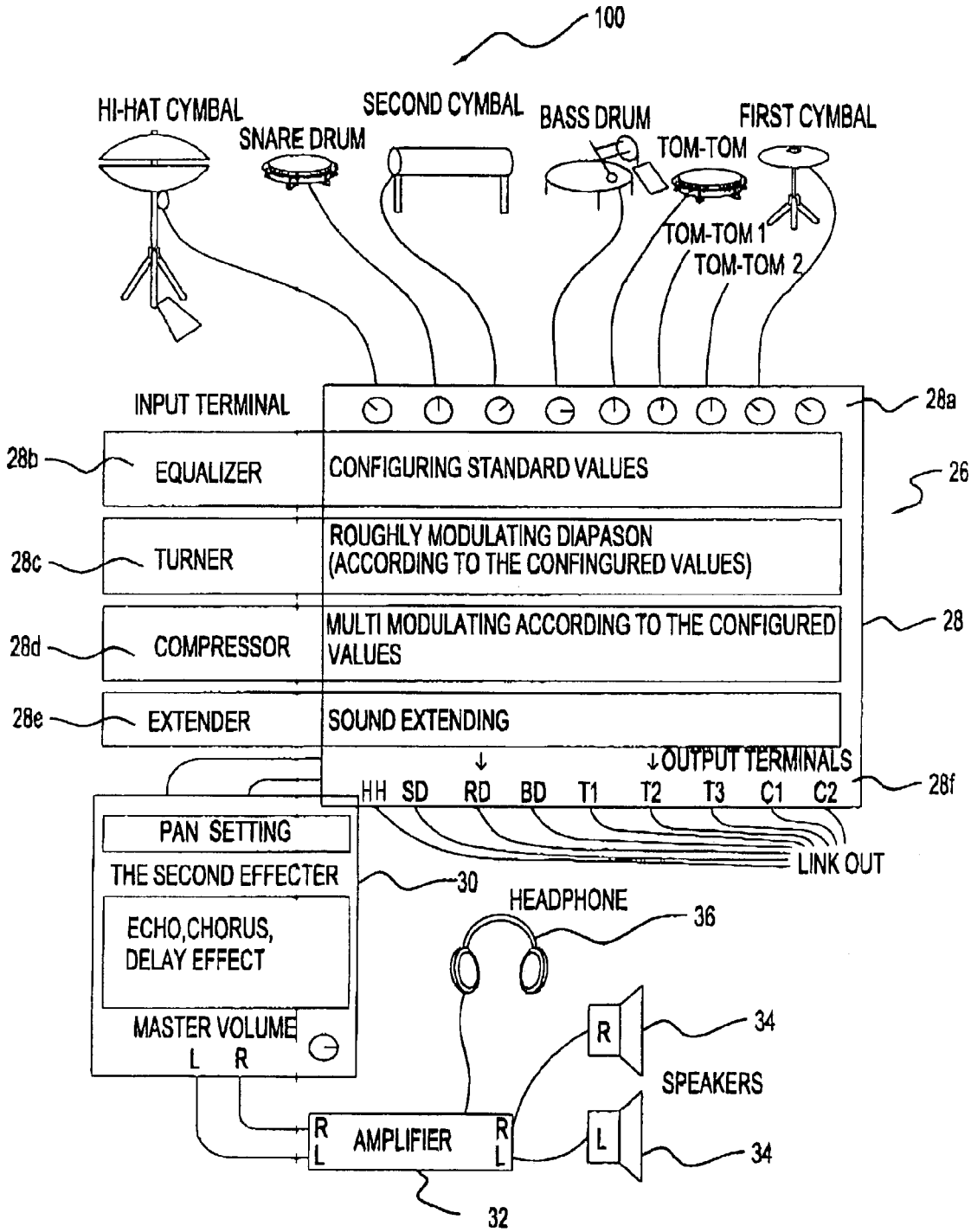
FIG. 1 is a schematic view of an embodiment of an analog electronic drum set in accordance with the invention.

The preferred embodiment of the present invention will now be described in detail, taken in conjunction with the accompanying drawings. The same parts in the drawings are indicated by the same numerals, and some repeated parts are omitted. In addition, the scope of the invention will not be limited in the preferred embodiment that is only a practicable example.

FIG. 1 is a schematic view of an embodiment of an analog electronic dram set 24 in accordance with the invention. As shown in FIG. 1, the invention comprises elements corresponding to a conventional drum set, wherein first original sound generators (100) can generate beating sounds and attenuation sounds, augmented microphones or microphones (not shown in this figure) installed in the first original sound generators (100) can receive the beating sounds and attenuation sounds, convert these sounds into electronic sounds, and transmitted into a sound modulator (26). When being a drum element, the first original sound generator (100) without resonator can generate beating sounds and attenuation sounds quieter than a conventional drum in performance. Moreover, cymbal elements in the first original sound generators (100) are miniaturized and also can generate beating sounds and attenuation sounds quieter than a conventional cymbal in performance.

The resonator mentioned in the specification means a closed chamber defined between a batter head and a shell of a drum. Therefore, the drum with the batter head and the shell does not always have a resonator defined therein. In a case that an opening is defined in the shell, there is no closed chamber defined between the batter head and the shell.

In addition, the drum elements of the first original sound generator (100) have adjusting members to adjust tensions of the batter heads.

In this embodiment, the sound modulator (26) is composed of a first effecter (28) for modulating original sounds, and a second effecter (30) connected with a rear end of the first effecter (28) for other purposes. As illustrated, the electronic sounds from the microphones are transmitted through a plurality of input terminals **(28*a*) of the first effecter (28) into in turn an equalizer (28*b*), a tuner (28*c*), and a compressor (28*d*), etc. Afterwards, sounds from the first effecter (28) are transmitted into the second effecter (30)** including an echo, an chorus, an delay, and an ambient, etc.

The sound modulator (26) will not convert the analog sounds (acoustics sounds) from the augmented microphones or microphones into digital signals, namely digital data, but can amplify the sounds, intensify the tones, modulate the diapasons and pressures, etc. Therefore, by the sound modulator (26), the quiet sounds from the first original sound generator (100) can be amplified to approximate actual sounds of the conventional drum set in performance, with a tone color with pressure.

In addition, the input terminals **(28*a*)**, which has the function to making basic volume of the beating sounds and attenuation sounds equal, can receive the beating sounds and attenuation sounds of the elements of the drum set from the augmented microphones or microphones.

The equalizer **(28*b*) of the first effecter (28)** can set standard values of the elements, for example, modulating the original sounds approximate to the actual sounds of the elements for the conventional drum set.

The tuner **(28*c*)** can roughly modulate the sounds to change their diapasons.

The compressor (28*d*) can set the original sounds approximate to the conventional tone colors in stages. The settings can generally include five stages: for example, 1-normal, 2-magnificent, 3-compact, 4-deep, and 5-mild. Finally, the first effecter (26) can further include an extender (28*e*) for lengthening or shortening the sounds.

When finishing these settings, a record processing of the sounds is accomplished.

In this embodiment, the first effecter (28) has a plurality of output terminals (28*f*). Namely, the sounds of various elements are respectively output from the corresponding output terminals (28*f*). Thus, in recording, it is easy to further ornament the sounds respectively. As described below, the sounds can also be output by an IEEE 1394 cable.

The second effecter (30) connected to the first effecter (28) is processed with a PAN setting, which configures phases of the elements in speakers.

The second effecter (30) can provide the sounds with effects of echo (generating echo), chorus (expanding sounds), delay (repeating sounds), etc. Finally, the volume of the sounds are adjusted by a master volume knob, and the processed sounds are output from stereo output terminals. The processed sounds are amplified by an external amplifier (32) and reproduced by speakers (reproducers) (34). Of course, the reproducer also can be a headphone (36) or the like.

In this embodiment, the sound modulator (26) will not digitally convert the original sounds, and only modulate the tones of the original sounds generated by the first original sound generator (100). Because the sound is not digitized, e.g. without a processing to convert the sounds into MIDI signals and reproduce recorded sounds, there is no time difference between the beat actions and the reproduced sounds.

According to the processing as described above, a very slight sound generated in the original sounds generator (100) is sufficient for the sound reproductions. Thus, when using the headphone or an earphone but not speakers to reproduce the sounds, there is almost no noise in a site without any sound arrester.

Different from the conventional electronic drum sets, the present invention is not provided with the pad for turning on the switch, and can directly use actual beating sounds and attenuation sounds generated by the first original sound generator (100), so that subtle distinctions in the performance techniques can be reflected and reproduced. Thus, using various mallets and holding manners can generate distinctive reproduced sounds.

Drum elements as the first original sound generator (100) will now be described below.

Figure 2:
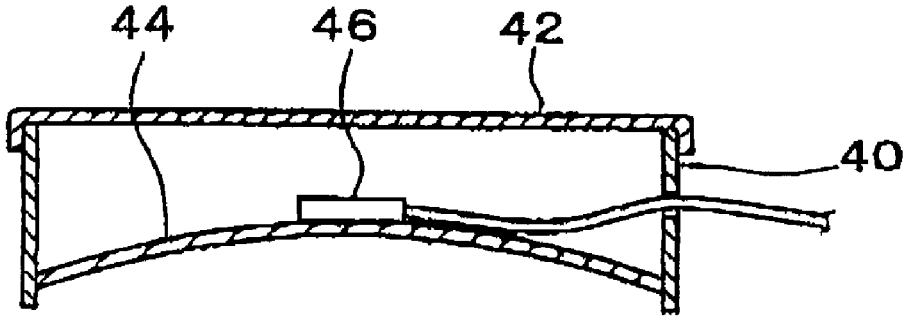
FIG. 2 is a sectional view of a drum element in accordance with the invention.

As shown in FIG. 2, the drum element as the first original sound generator (100) is a snare drum (40). In this embodiment, a batter head of the snare drum (40) is a flat surface with a metal material, or a netlike head (42) with a metal material.

Figure 3:
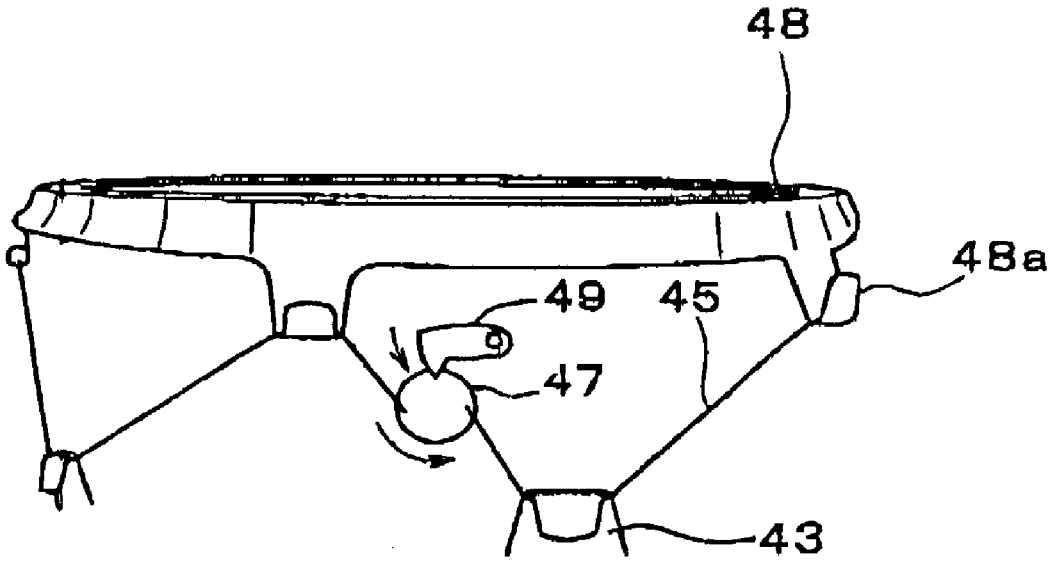
FIG. 3 is a perspective view of the drum element in accordance with the invention.

Referring to FIG. 3, in assembling, the batter head (42) is provided on a shell (not numbered), and a line (45) is extended through upper hooks (48a) formed at an upper edge (48), lower hooks (43) formed on the shell, and an adjusting knob (47). The line (45) can be tensioned by turning the knob (47) and locked by a locking member (49).

Figure 32:
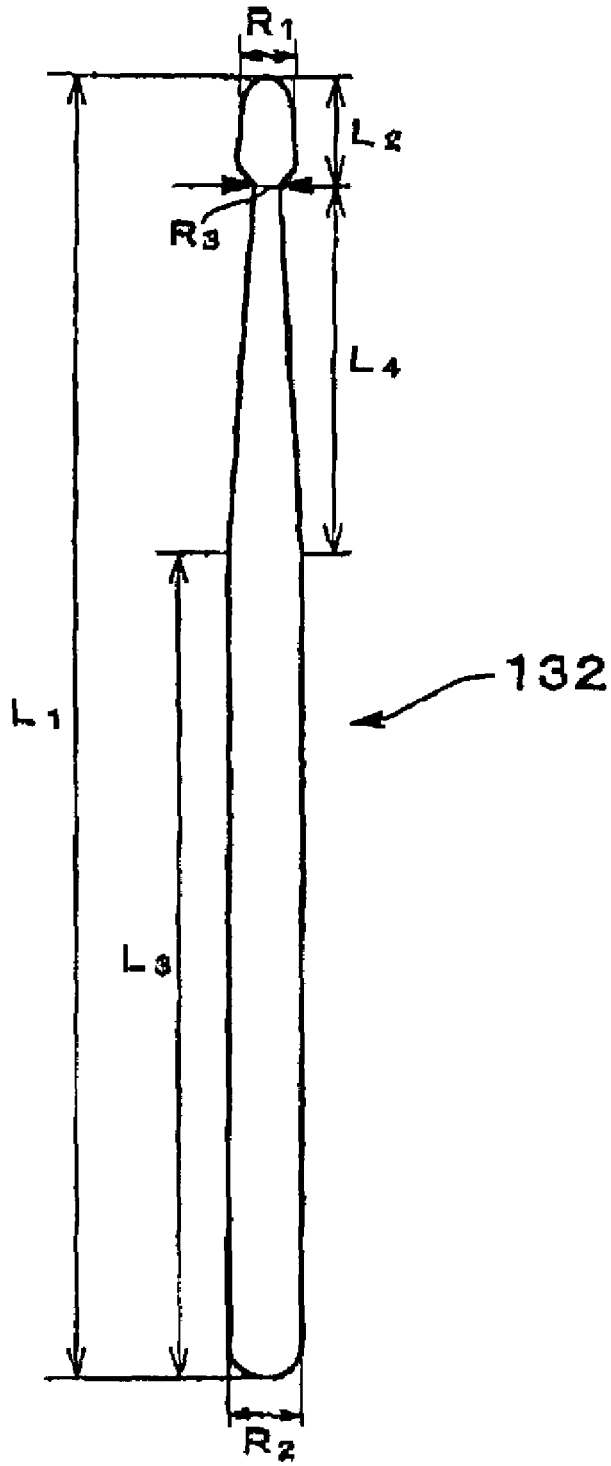
FIG. 32 is a schematic view of a stick in accordance with the invention.

An example of a stick used for the snare drum (40) as described above and for hitting elements (101, 107) is shown in FIG. 32.

As illustrated, the stick (132) is about 39–45 cm in an overall length L1. A front beating portion of the stick (132) is about 3.5–4 mm in a diameter R1 and about 8–10 mm in a length L2. A rear portion of the stick (132) is about 8–10 mm in a diameter R2 and about 23–35 cm in a length L3. A middle portion between the front portion and the rear portion spreads out gradually 2–2.5 mm in a diameter R3 and 10–15 cm in a length L4. The mass of the mallet (132) is about 12–18 g. The stick (132), which is made of an elastic and durable material, such as bamboo, can be used as a means to generate slight beat sounds. The conventional sticks are generally made of walnut or oak, of which a standard mass is 60 g, and of which a rear portion has a standard diameter R2 of 14–15 mm.

The reason to use the stick with this specification will now be described.

Because the original sounds should be as quiet as possible, the drum elements are not provided with resonators. Moreover, sizes of the drum element as the first original sound generator are smaller than the drums of the conventional drum set, which can minimize the drum set and so make the drum set easy to transport. If the conventional stick is used for beating the drum elements of the invention, the drumbeats will be depressing with quick attenuation and low rising tone because there is a large contact area between the conventional stick and the batter head.

Thus, a proportion of the stick and batter head of the present invention should be substantially equal to the proportion of the conventional stick and batter head.

By using the stick (132) as described above, the proportion of the stick and batter bead can be substantially equal to the conventional proportion, so that the drumbeats will be sharp with sufficient attenuation and tone rising.

Using the stick as described above to beat the batter head, the sounds will be not only sharp, but also quiet.

The sizes of the analog electronic drum set that are suitable for the stick will be described in detail in reference to FIG. 27.

The structures of the microphones will now be described.

Figure 31:
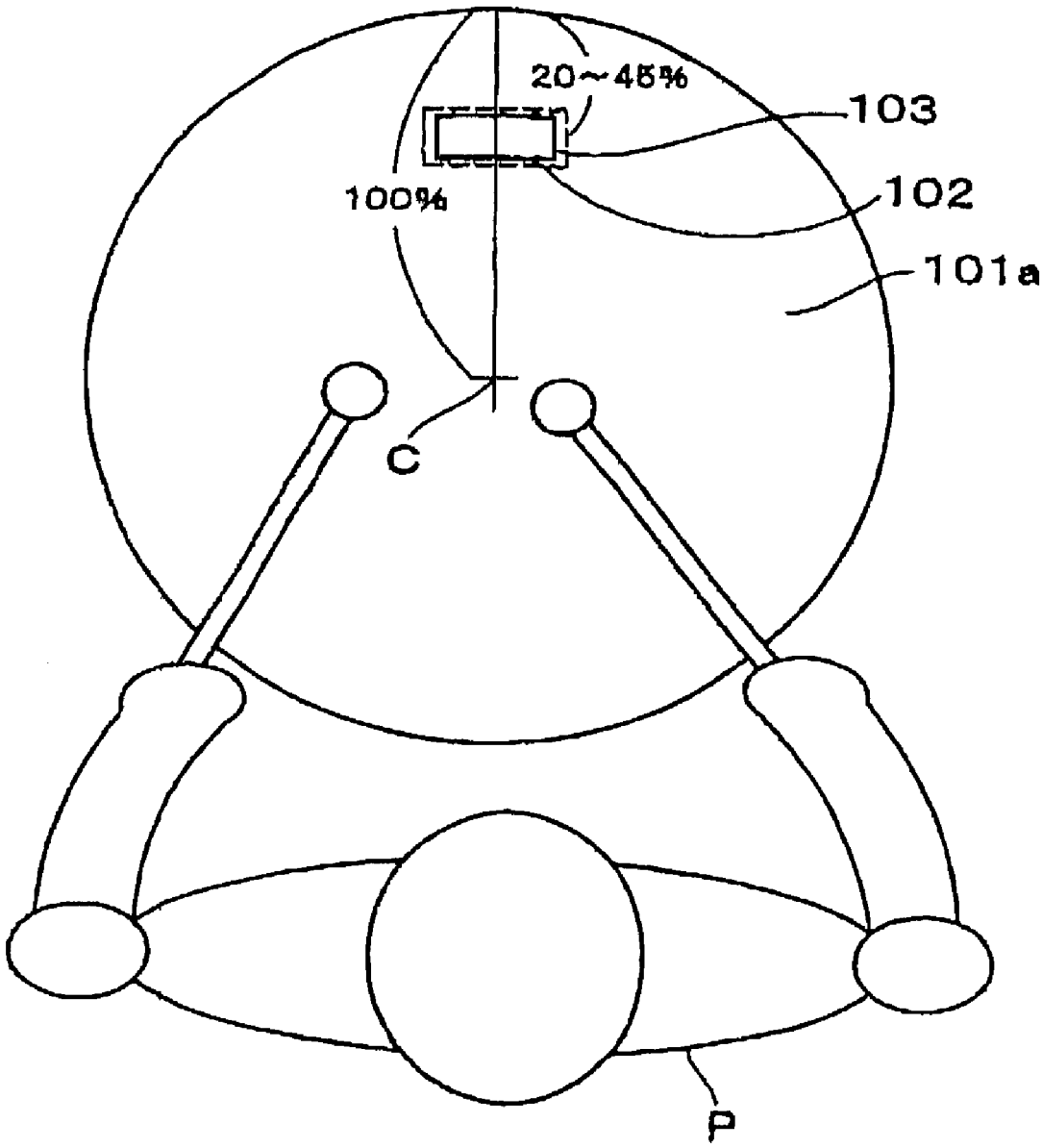
FIG. 31 is a schematic top view showing the augmented microphone installed in the drum element in accordance with the invention.

Referring to FIG. 2, the hollow drum element (40) has a bridge (44) formed therein. An augmented microphone (microphone) (46) is installed on the bridge (44), e.g. at a location corresponding to the batter head as shown in FIG. 31. Therefore, the augmented microphone (46) can be installed inside the drum element (40).

Figure 4:
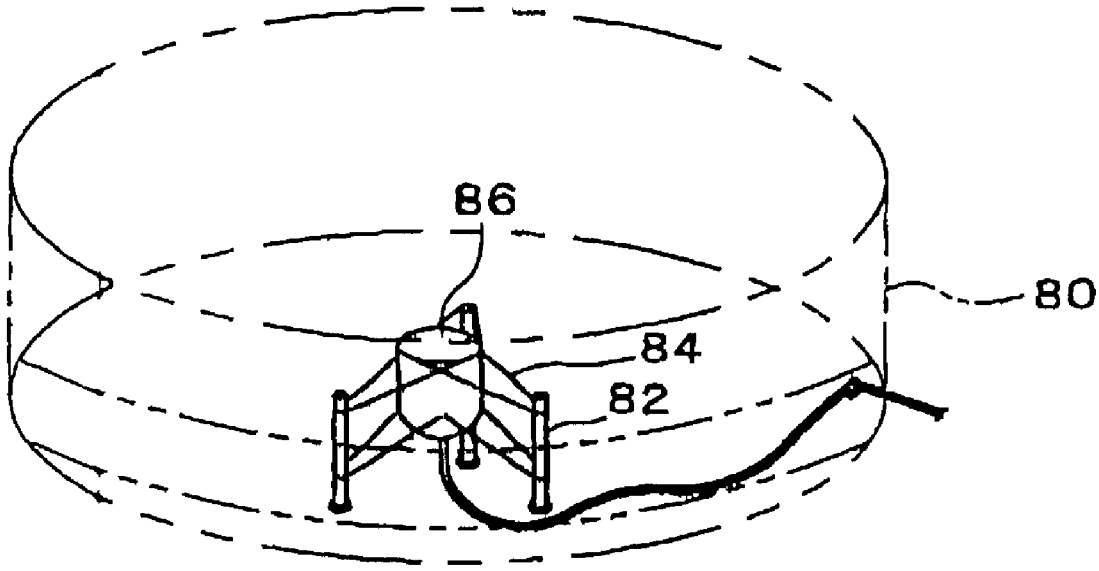
FIG. 4 is a perspective view of a microphone mounted in the drum element in accordance with the invention.

Another embodiment of the microphone is illustrated in FIG. 4.

As illustrated, another drum element (80) as the first original sound generator has three poles (82) provided therein. An augmented microphone (86) is suspended among the poles (82) by a plurality of elastic cords (84) attached to the poles (82). Thus, the augmented microphone (86) can be elastically supported.

The bridge (44) and the elastic cords (84) for installing the microphone are preferably made of a material, which can absorb shock and stably retain a distance of the microphone to an original sound generating point to prevent the microphone from repeatedly receiving the original sounds, superposition sounds and resonant sounds.

Figure 5A:
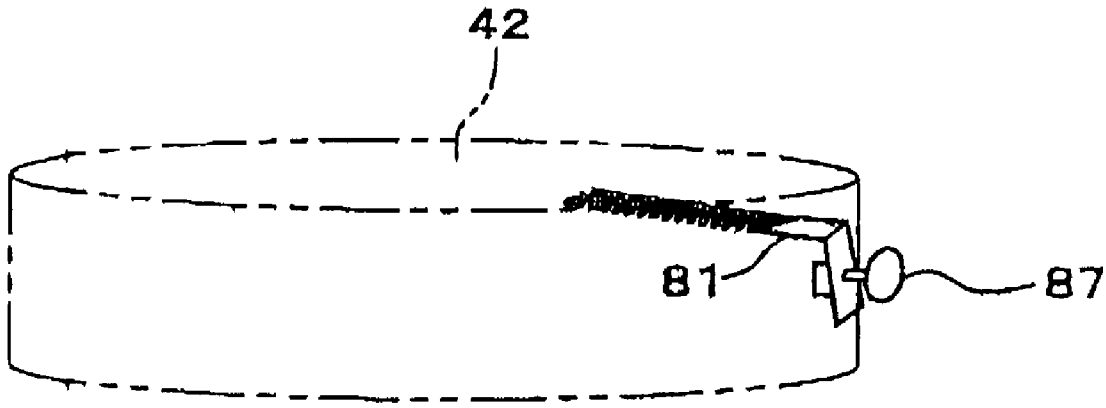
FIGS. 5A and 5B are schematically perspective views of a chain belt for a snare drum element in accordance with the invention.
Figure 5B:
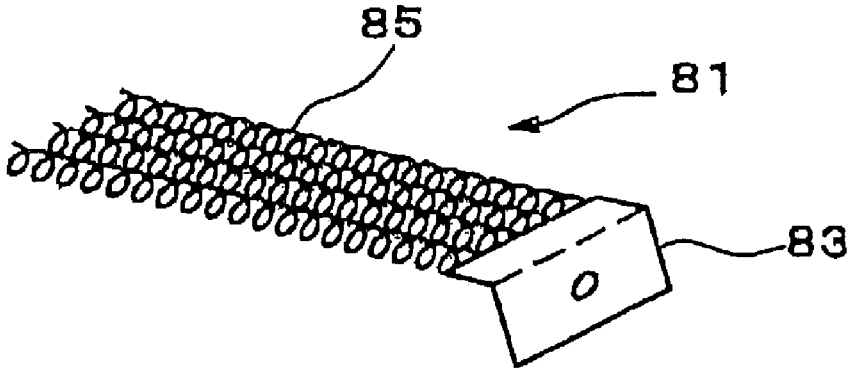

For the snare drum element (40), a sound status of a chain belt is important. FIG. 5 illustrates an embodiment of the chain belt, wherein FIG. 5A illustrates the chain belt (81) mounted on the drum element, and FIG. 5B illustrates that the chain belt (81) is composed of a base part (83) and a plurality of helical metal strips (85) provided on the base part (83). The metal strips (85) of the chain belt (81) can be in contact with the batter head (42). An adjusting means (87) with a spring and a screw is provided in the base part (83) for adjusting the metal strips (85) in contact with the top head (42) or not. By this means, the snare drum element can generate various original sounds.

Figure 6A:
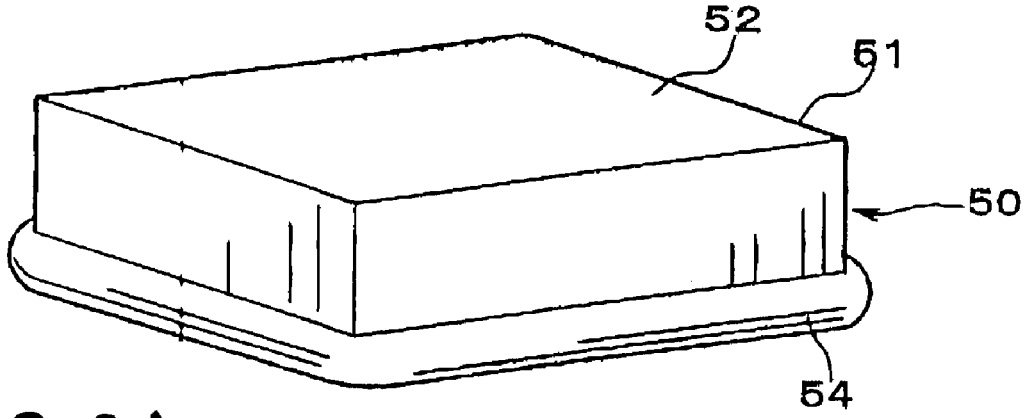
FIG. 6A is a schematically perspective view of a bass drum element in accordance with the invention.
Figure 6B:
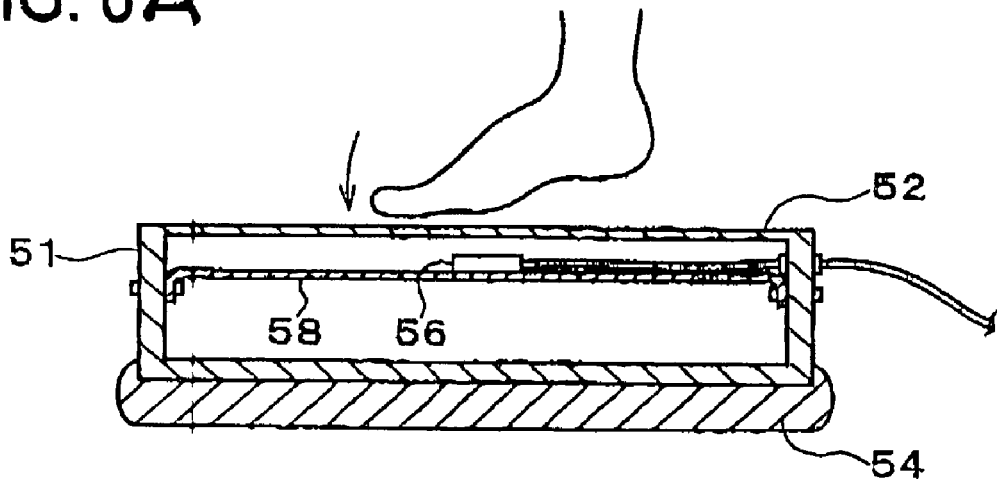
FIG. 6B is a schematically sectional view of the bass drum element in FIG. 6A.

Referring to FIG. 6, an embodiment of a bass drum element (50) as the first original sound generator, wherein FIG. 6A is a perspective view, and FIG. 6B is a sectional view. The bass drum element (50) has a box (51) with a flat batter head (52) for stepping on by a foot of a performer. In this embodiment, the batter head (52) of the bass drum element (50) is made of plywood with a thickness of 4 mm. The batter head (52) can also be made of other materials, which can generate the sounds approximate to the conventional bass drum, such as resin, etc.

As one of drum elements, the bass drum should be included in the drum elements as described below.

A cushion (54) is provided beneath the box (51) for absorbing impacts. Because the batter head (52) is directly beaten by the foot of the performer, compared with the conventional bass drum beaten by a pedal, only a little impact is transferred to the ground.

In the conventional bass drum beaten by the pedal, if a cushion is provided under the bass drum, the action of stepping the pedal will become unstable, so the soundproof manner is ineffective, Because the batter head (52) is horizontal, the performer can directly step on the batter head (52) by the foot, which is similar to a brushing technique in jazz.

The sounds generated by actions of directly stepping on the batter head (52) by the foot is milder than that by using the pedal, so the bass drum element can be used for performing quiet music and mild melodies.

An augmented microphone (microphone) (56) is mounted on a bridge (58) suspended in the box (51). The bridge (58) can be made of materials with various flexibilities.

Figure 7A:
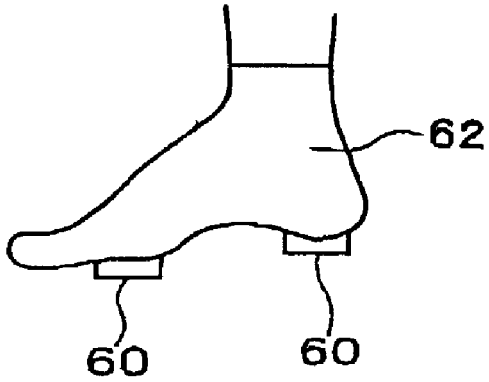
FIG. 7A is a schematic view of a beating member for the bass drum element in FIG. 6 and FIG. 10.
Figure 7B:
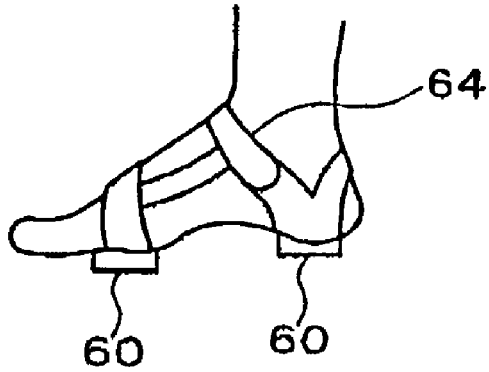
FIG. 7B is a schematic view of another beating member for the bass drum element in FIG. 6 and FIG. 10.
Figure 10:
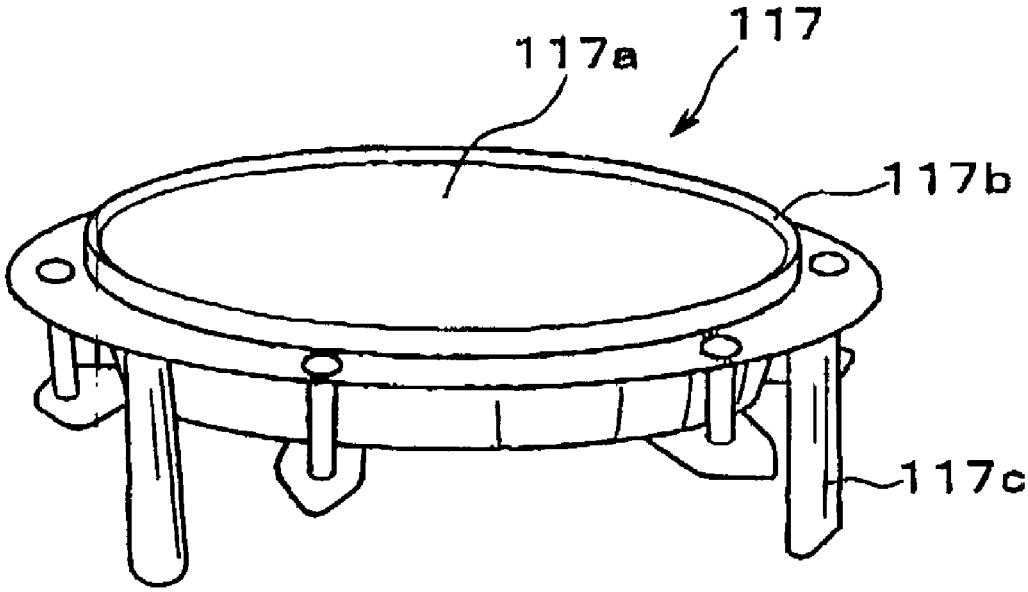
FIG. 10 is a perspective view of a drum element which can be played by the pedal assembly of FIG. 9 or FIG. 30.

FIG. 7 illustrates embodiments of a beating member used for performing the bass drums (50, 117) as shown in FIG. 6 and FIG. 10. Namely, for stepping on the batter heads (52, 117*a*), the beating members (60) are fastened on the foot of the performer. As shown in FIG. 7A, the beating members (60) are provided at a bottom of a sock means (62). As shown in FIG. 7B the beating members (60) are provided at a bottom of a slipper means (64). The beating members (60) can be made of materials with various hardnesses, such as metal or resin.

As described above, the performer with the beating members can slightly step on the bass drum element to generate desired drumbeats. According to various materials of the box (51) of the bass drum element (50) and the beating members (60), the bass drum (50) can generate various tones of the drumbeats. The beating members (60) are optional elements, and the bass drum element (50) can be directly beaten by the foot of the performer. In this case, the tones of the drumbeats will be mild and can represent the personality of the performer.

Figure 29:
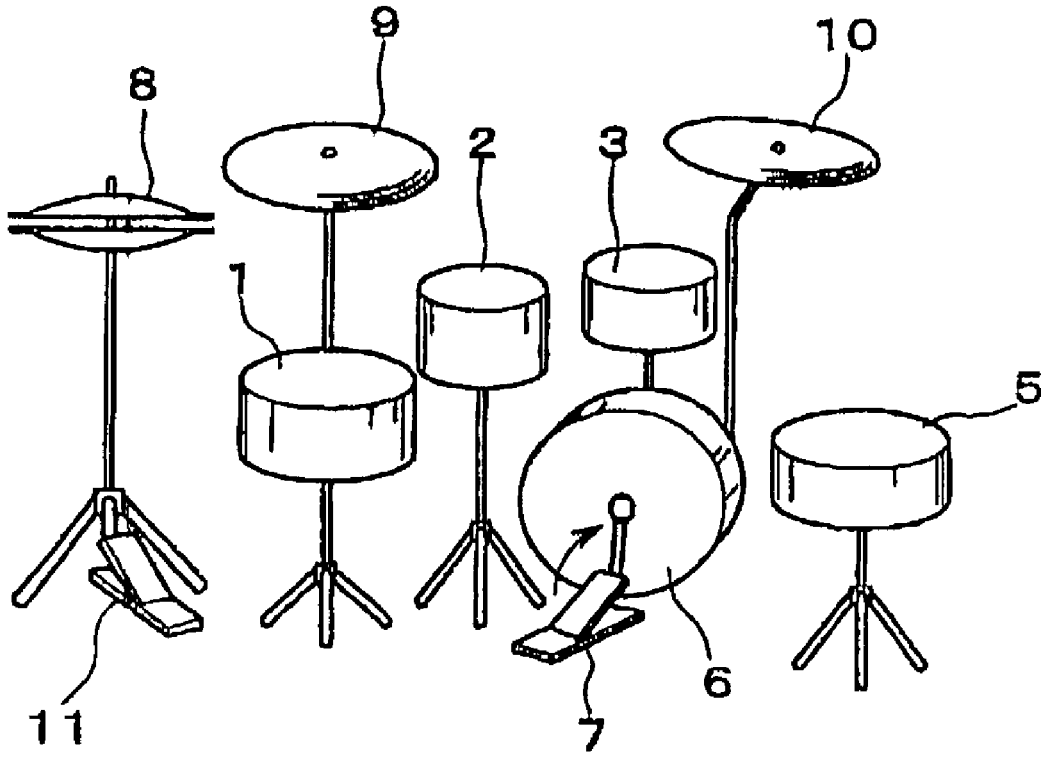
FIG. 29 PRIOR ART
FIG. 29 is a perspective view of a conventional drum set.

The conventional pedal (7) used for a conventional bass drum (6) is illustrated in FIG. 29. When the pedal (7) is stepped on, a pulley on the pedal (7) is driven by a chain or belt to rotate, and a drumstick formed on the pulley is turned to beat a vertical batter head of the bass drum. The downward force to step on the pedal is transformed to a lateral force to drive the drumstick to beat the batter head. Because the downward force is different from the lateral force, a performance of the pedal will affect the drumbeats effect of the base drum.

One of the conventional pedals has been disclosed in JP publication number 44234, 1989. When used for beating a vertical batter head of a bass drum, the disclosed pedal also has the problem as described above.

Figure 8:
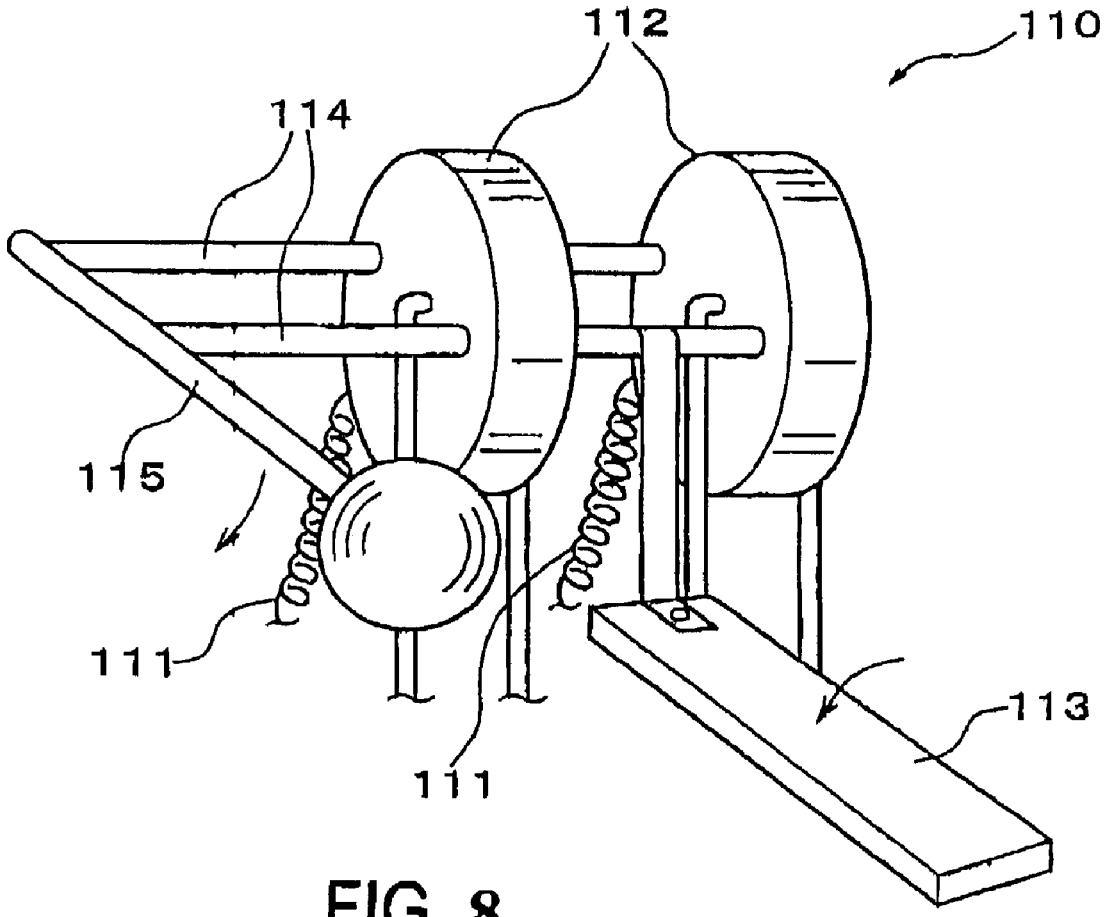
FIG. 8 is a perspective view of a pedal assembly for the bass drum element in accordance with the invention.

As a solution of the problem, referring to FIG. 8, a pedal assembly (110) in accordance with the invention has two pulleys (112) with a potential to rotate towards a predetermined direction, under elastic forces of two resilient members (111) respectively attached to the pulleys (112). Two axles (114) are extended through the pulleys (112). A pedal (113) is mounted on one of the axles (114) and used for driving the pulley to rotate when stepped on. A drumstick (115) is laterally provided at distal ends of the axles (114) and located at a side the same as the pedal (113).

The drumstick (115) can be turned to the front and down to beat the batter head (not shown) when the pulleys (112) are rotated.

Figure 9:
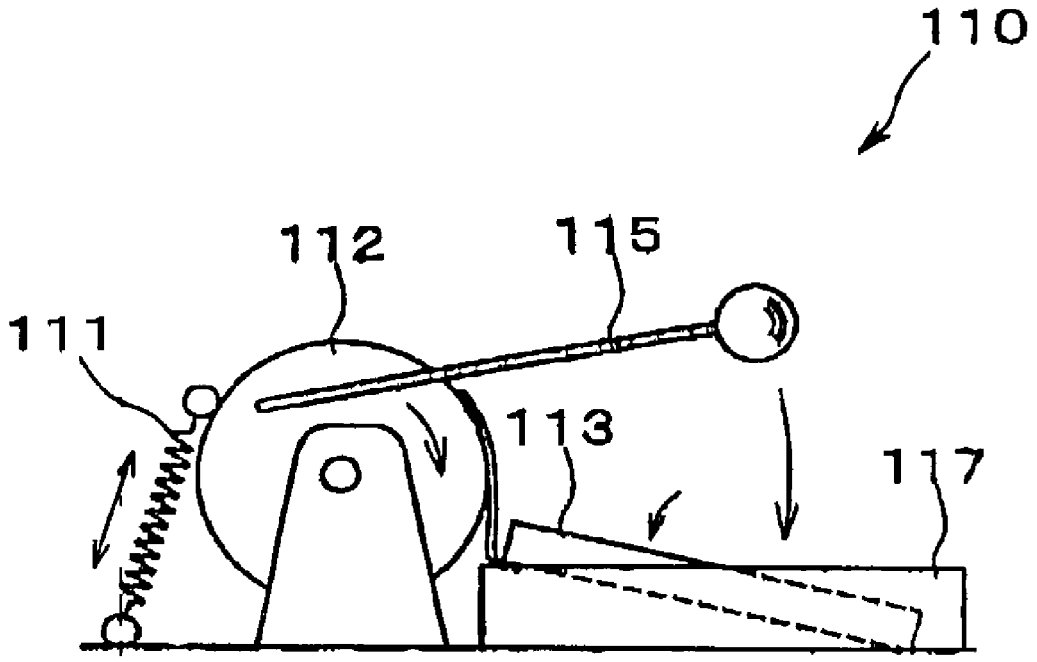
FIG. 9 is an operational schematic view of FIG. 8 and FIG. 30.

Referring to FIG. 9, the drumstick (115) can be moved in a direction the same as the pedal (113), so the stepping action and the beating action of the drumstick (115) are synchronous.

After stepping on the pedal (113) and beating by the drumstick (115), the performer can directly step on the batter head by the foot. Alternatively, the performer also can first directly step on the batter head by foot, and then step on the pedal (113). Thus, the bass drum element can be beaten with more performance styles.

Figure 30:
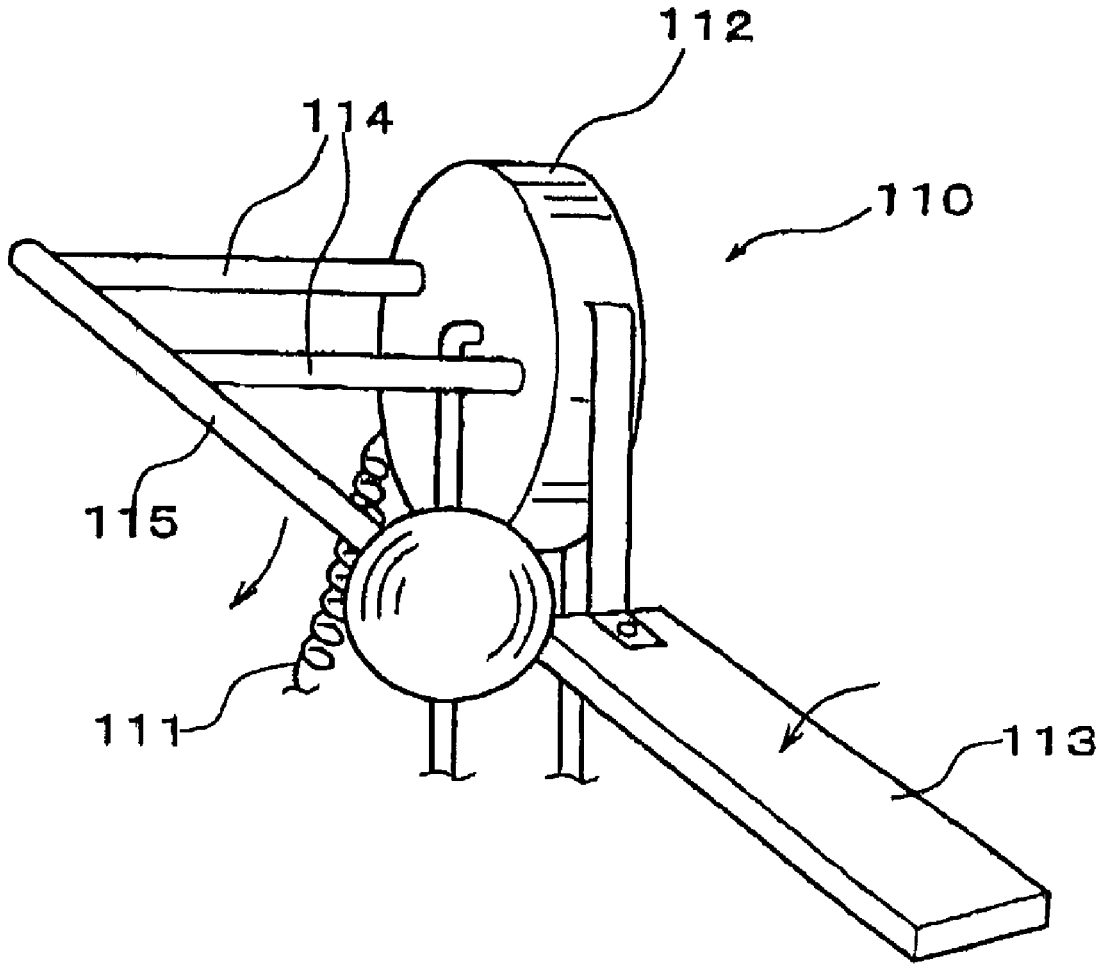
FIG. 30 is a perspective view of another embodiment of the pedal assembly for the bass drum element in accordance with the invention.

Referring to FIG. 30, the pedal assembly (110) can include only one pulley (112), which can reduce the element quantity and can facilitate the performer to drive the pedal with a small force.

As shown in FIG. 30, the pedal (113) is directly mounted on the pulley (112), different from the pedal (113) in FIG. 8 mounted on the axle (114).

For example, it is especially effective to put a pulley, and put a wire on the axle (114) which projected on both side, and extend it in a V shape. A part on the corner of the V shape connects to a charge stops of a ring part of the pedal (113).

As shown in FIGS. 8, 9, 20, 27 and 30, the pulleys are formed with a wheel shape. Of course, the pulleys can also be formed with other shapes, such as T-like, triangular, etc.

A drum element (117) in the first original sound generator (100) beaten by the pedal assembly (110) is shown in FIG. 10.

The drum element (117) in FIG. 10 is a horizontal bass drum with a horizontal batter head (117*a*). The drum element (117) has an edge (117*b*), and the batter head (117*a*) is fixed on the edge (117) with a certain tension. The drum element (117) is supported by three legs (117*c*) to provide a height of 8 cm between the batter head (117*a*) and the ground.

Figure 11:
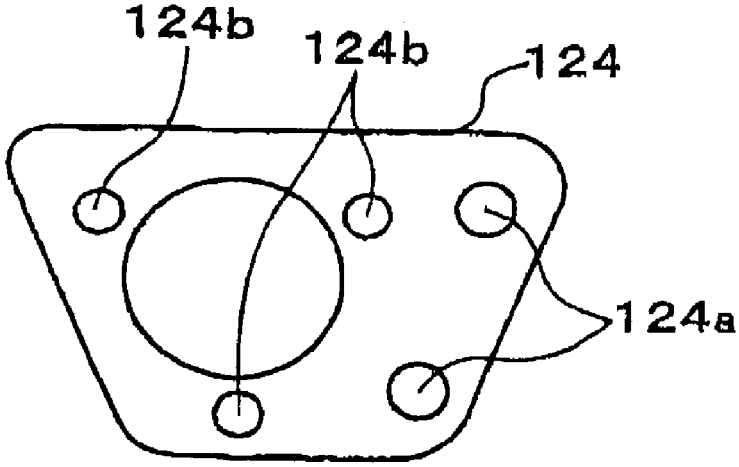
FIG. 11 is a schematic view of a bottom plate used for securing the pedal assembly of FIG. 8 or FIG. 30 and the drum element of FIG. 10.

Referring to FIG. 11, the pedal assembly (110) as shown in FIG. 8 or FIG. 30 and the bass drum element (117) as shown in FIG. 10 can be secured on a bottom plate (124) to prevent the displacement between the pedal assembly (110) and the drum element (117).

As illustrated, the bottom plate (124) has first holes (124*a*) for securing the pedal assembly (110), and second holes (124*b*) for securing the legs (117*c*) of the drum element (117).

By this means, the pedal assembly (110) can not be displaced from the drum element (117).

Figure 12:
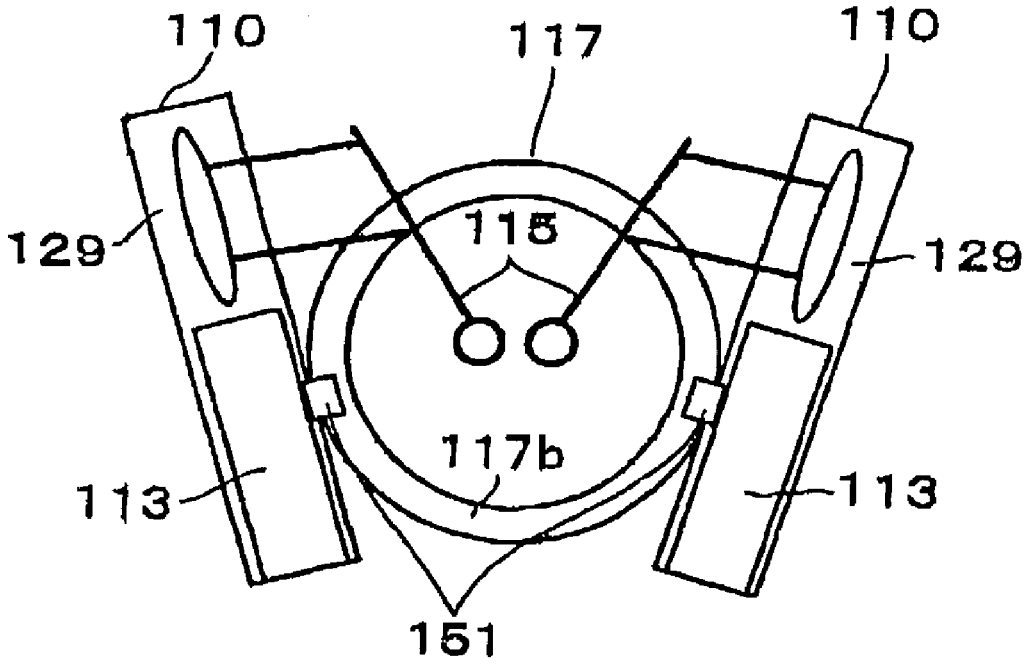
FIG. 12 is a schematic view showing the pedal assembly of FIG. 8 or FIG. 30 provided beside the drum element of FIG. 10.

Referring to FIG. 12, the drum element (117) can be provided with two pedal assemblies (110) at both sides thereof, or provided with one pedal assembly (110) at a left side thereof. According to another embodiment, base plates (129) of the pedal assemblies (110) can be secured to the edge (117*b*) at connecting points indicated by the numeral 151 by a known method.

Figure 13:
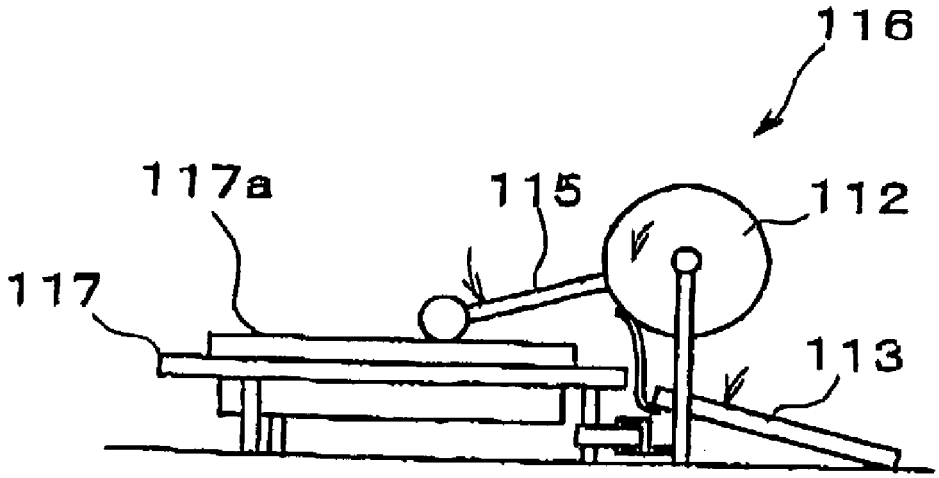
FIG. 13 is a schematic view of the drum element of FIG. 10 beaten by a conventional pedal assembly.

Furthermore, instead of the resilient members (111), rubber means can be used for providing the elastic forces to provide the pulleys (112) of the pedal assembly (110) with the potential to rotate towards a predetermined direction. Moreover, the drumstick (115) can be directly mounted on the pulleys (112) instead of the axles (114), Referring to FIG. 13, a conventional pedal assembly (116) can also be used for beating the drum element (117). The conventional pedal (116) has a pulley (112), a pedal (113) and a drum tick (115) located at a side opposite to the pedal (115). When the pedal (113) is stepped on, the pulley (112) is rotated to turn the drumstick (115) downwards to beat the batter head (117*a*).

Figure 14:
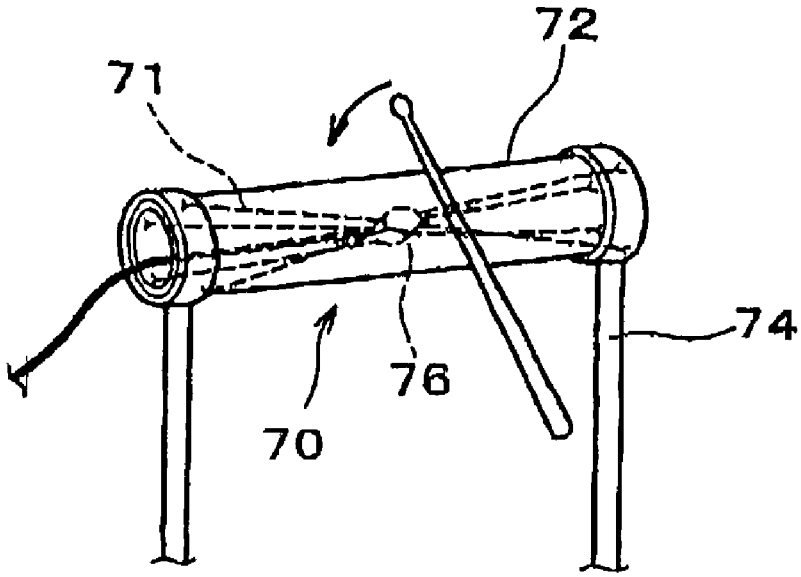
FIG. 14 is a perspective view of a cymbal element in accordance with the invention.

FIG. 14 illustrates an embodiment of a cymbal element (70) as the first original sound generator.

In this embodiment, the cymbal element (70) can be used as a means to generate continuous sounds. The cymbal element (70) has a tubular body (72) with two open ends, made of a metal material, such as iron. Two supports (74) are respectively provided near the open ends of the tubular body (72). An augmented microphone (microphone) (76) is suspended by a plurality of lines (71) at a center of the tubular body (72). Beating the tubular body (72) can generate sounds. The tubular body (72) can be formed with various diameters and lengths for generating various tones.

The cymbal element (70) will not generate loud sounds but can reflect the subtle distinctions in techniques used by the performer. For example, the cymbal element (70) can represent distinctions in original sounds when the performer uses various sticks and techniques.

Instead of the tubular body, a minimized conventional disk-like cymbal can be used for generating quit sounds.

The cymbal elements mentioned in the specification include not only a cymbal with a single disk beaten by a stick, but a cymbal with two disks beating each other to generate sounds.

The augmented microphones for the drum elements and the cymbal elements will now be described in detail. The drum elements mentioned in the specification include tom-toms, the snare drum, the bass drum and other percussion instruments (Conga, Bongo, Tambourine, surdo, Djernbe, Timbale, etc.), which can generate sounds by using sticks, hands or feet to beat batter heads with tensioned membranes.

The mentioned augmented microphone is a microphone which includes magnetic material such as iron, and can electrically augment vibrations of the magnetic piece. The augmented microphone has a coil formed with an alnico wire reeled on a magnet and a soft iron-core or a club-shaped magnetized soft iron electrically connected together. When the magnetic piece is vibrated, an induced current is generated in the coil. The induced current is amplified by an amplifier, the sound, e.g. the beating sounds and attenuation sounds to vibrate the magnetic piece, can be reproduced and output from the speakers. In this embodiment, the magnetic piece is made of iron. However, the magnetic piece can also be made of other magnetic material, or a plurality of magnetic pieces can be integrally formed together.

The augmented microphone can be a single coil type, or a double coil type called a noise-isolator (noise-eliminating microphone). The noise-isolator includes two coils connected together side by side to isolate (eliminate) noise. The single coil type microphone sealed with wax can also isolate noise.

Figure 15:
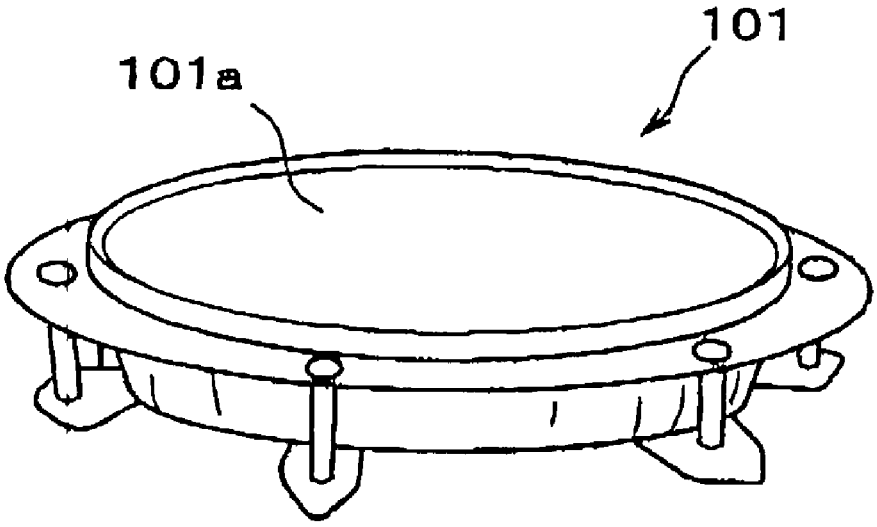
FIG. 15 is a perspective view of a drum element in accordance with the invention.
Figure 16:
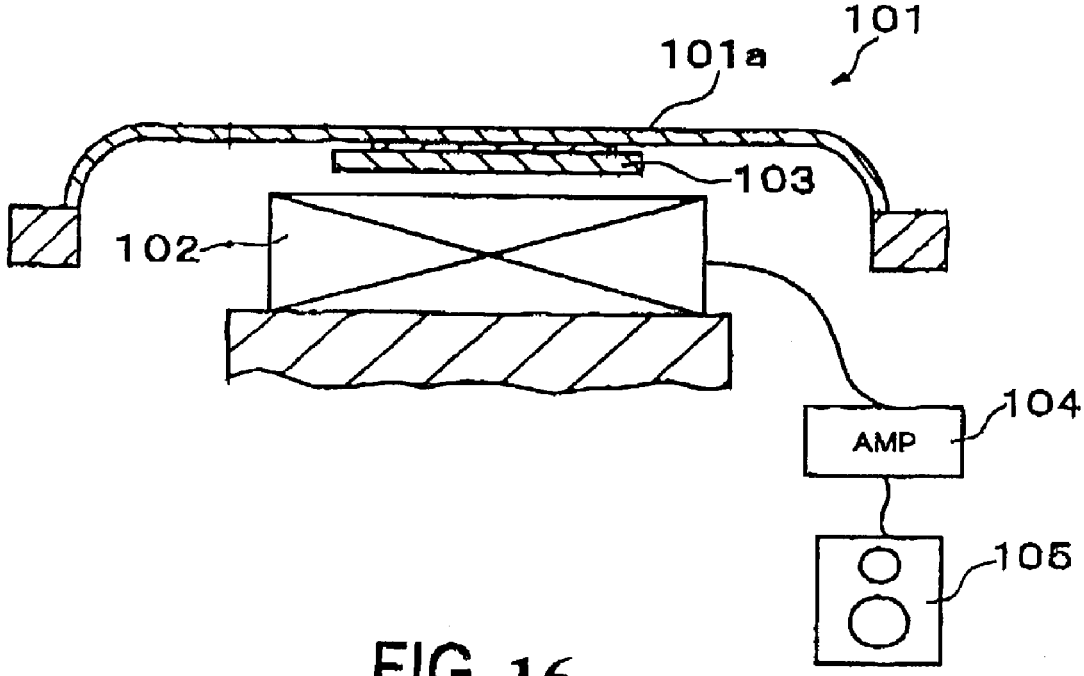
FIG. 16 is a schematic view showing a means to install an augmented microphone in the drum element in FIG. 15.

Referring to FIGS. 15 and 16, a drum element (101) as the first original sound generator is provided with an augmented microphone (102) inside the batter head (101*a*) thereof. There is a gap (for example, about 2–3 mm) between the augmented microphone (102) and the batter head (101*a*). A metal sheet used as a vibration source (1103) is adhered on an inner surface of the batter head (101*a*) by an adhesive or a double-sided adhesive tape. The vibration source (103) can be made of magnetic materials, but is not limited to the magnetic materials.

In this embodiment, the vibration source (103) has a size of 10 mm×20 mm, and a thickness of 0.3 mm.

By this means, beating the batter head (101*a*) can vibrate the vibration source (103). The vibration is received by the augmented microphone (102) and electronically amplified by an amplifier (amplifying means) (104). Then, the speakers (reproducers) (105) can output a loud sound.

In the drawings after FIG. 16, the sound modulator (26) (as shown in FIG. 1) is omitted between the microphone and the amplifier.

Figure 17:
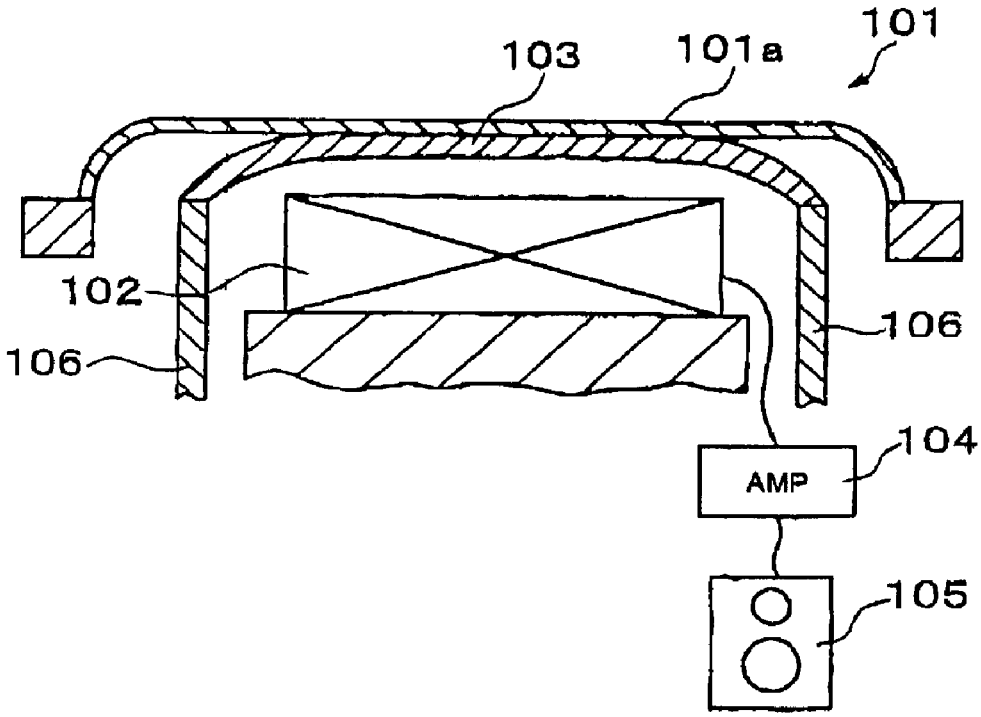
FIG. 17 is a schematic view showing another means to install the augmented microphone in the drum element in FIG. 15.

Referring to FIG. 17, in another embodiment, an arcuate vibration source (103) is supported by two flexible rubber or resin posts (106) and abutted the batter head (101*a*). Beating the batter head (101*a*) can vibrate the vibration source (103), and the vibration is received by the augmented microphone (102). Receiving means about the arcuate vibration source (103) abutting the batter head (101*a*) as shown in FIG. 17 will be described in detail later taken in conjunction with FIGS. 36–42.

In the embodiment as described above, the vibration source (103) is directly adhered to or abutted the batter head (101). There may be a gap between the vibration source (103) and the batter head (101*a*) as long as beating the batter head (101*a*) can vibrate the vibration source (103).

In another embodiment, the batter head (101*a*) can be made of a magnetic material so as to eliminate the vibration source (103). Namely, the batter head (101*a*) can be made of synthetic resin mixed with some magnetic material such as iron. Therefore, when beating the batter head (101*a*), the augmented microphone (102) can receive the vibration.

An embodiment of the arced vibration source (103) abutted the batter head (101*a*) is the best one of other embodiments. The adherence of the vibration source (103) to the batter head (101*a*) involves a time-consuming procedure, end is often unsatisfactory such that the vibration source (103) will often disconnect from the batter head (101*a*) after use for a period of time. Moreover, the batter head (101*a*) directly made of a magnetic material needs to be developed. Therefore, if the vibration source (103) is abutted the batter head (101*a*) by the posts (106), various known batter heads available on the market can be selectively used.

JP publication number 7455, 1973, has disclosed a technology to attach a metal plate as a vibration source to a batter bead. In this disclosure, the vibration source is located at the center of the batter head. However, it is allowable not to locate the vibration source at the center of the batter bead, as disclosed in the present invention.

The reasons with be described hereinafter.

The center (C) of the batter head (101*a*) is the most common position beaten by the performer. When the vibration source (103) is positioned at the center of the batter head (101*a*), the vibration source (103) will be directly beaten and damaged to result in serious volume differences, and will not generate stable beating sounds. Especially when the vibration source (103) is made of a metal material, directly beating will distort and detach the metal plate from the batter head.

An area, in which distances from a side opposite to the performer (P) towards the center (C) are 20–45% of a radius, is the least common position beaten by the performer. The vibration source is preferably provided in the area that can receive the beating sounds and the attenuation sounds.

The circular pad illustrated in FIG. 2, as disclosed in JP publication number 7455, 1973, is used for controlling amplitudes of a batter membrane of a drum with a large diameter. Although the elastic member made of a soft material can control the amplitudes and restrain attenuation of sounds, the sounds are turbid and it is difficult to receive treble sounds.

Therefore, the drum element with a diameter below 14 inches (35.56 cm) can reduce the amplitudes, and is easy to be carried. Using the arcuate magnetic piece can reduce a contact area with the inner surface of the batter head. The soft and flexible magnetic piece can facilitate the microphone to filly receive the treble sounds.

Figure 18:
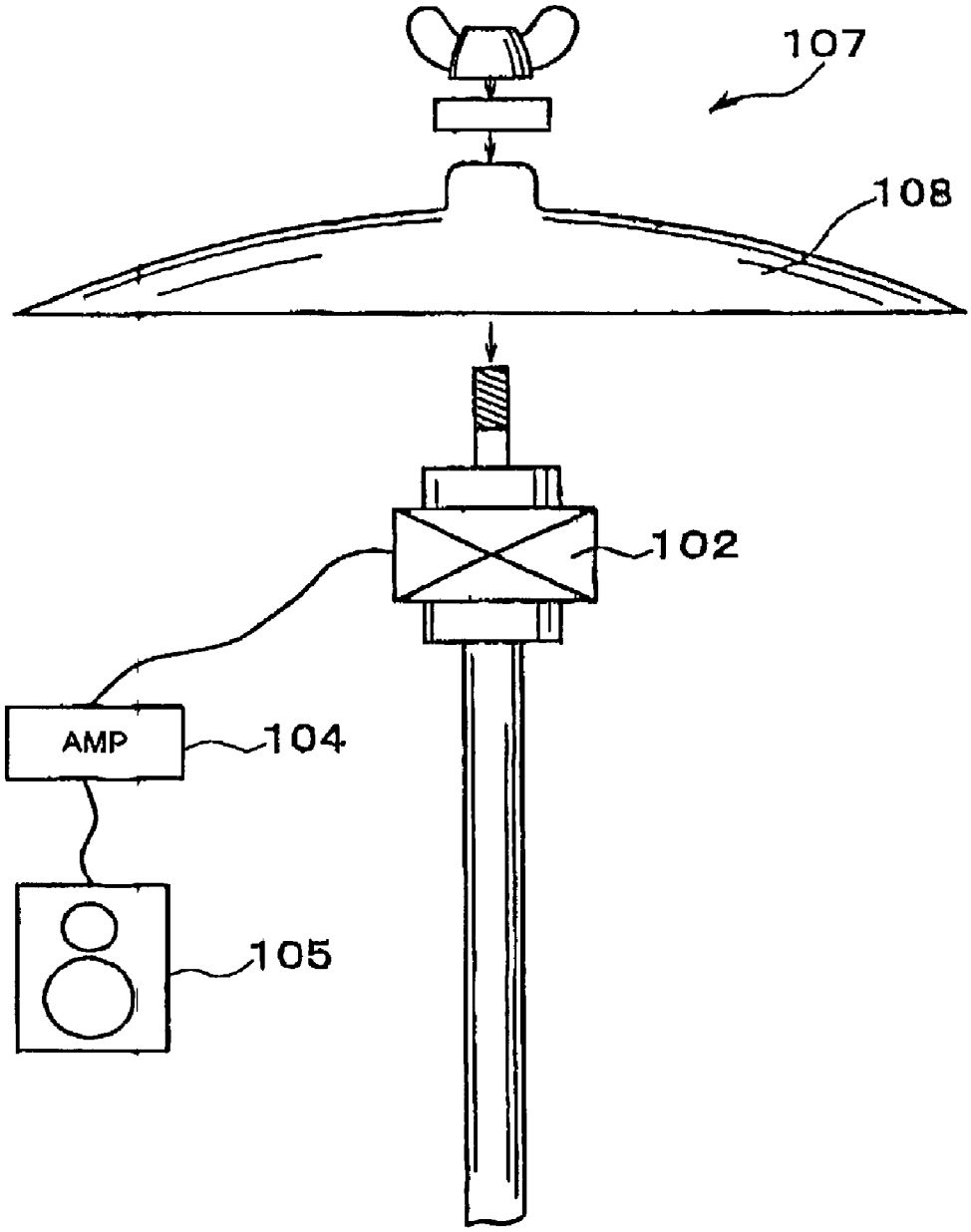
FIG. 18 is a schematic view showing a means to install the augmented microphone on a cymbal element in accordance with the invention.
Figure 19:
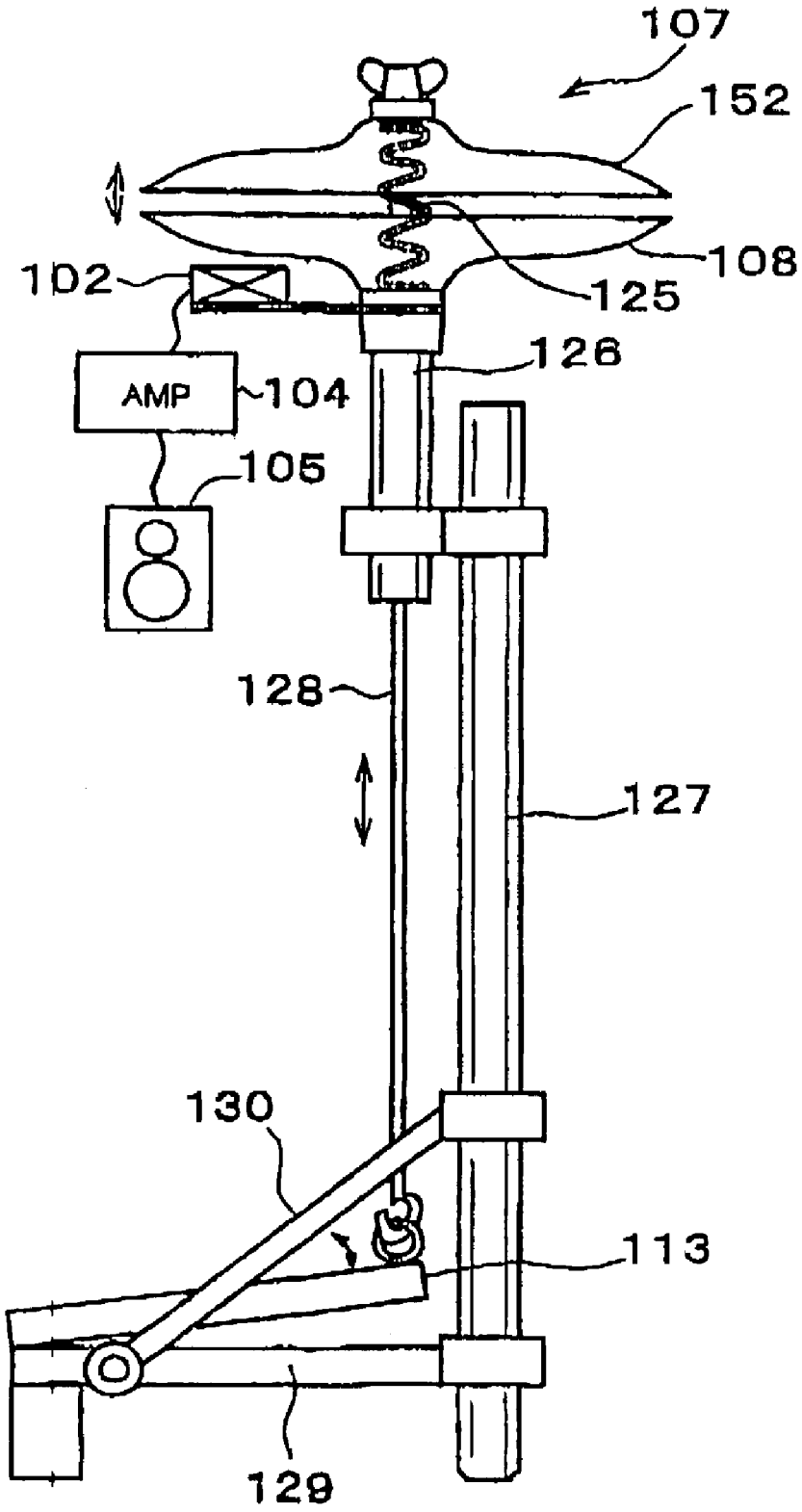
FIG. 19 is a schematic view showing another means to install the augmented microphone on another cymbal element with a pedal in accordance with the invention.

Referring to FIG. 18, in a cymbal element (107), the first original sound generator (108) is made of a magnetic metal. An augmented microphone (102) is provided at a position where vibrations of the first original sound generator (108) can be detected (in this embodiment, on a cymbal stand). In this case, a sponge elastic member can be provided between the augmented microphone (102) and the first original sound generator (108). As shown in FIG. 19, in a hi-hat cymbal (107), the augmented microphone (102) can be provided under the lower cymbal.

In the hi-hat cymbal (107), the first original sound generator is the lower cymbal (108), and a second original sound generator is an upper cymbal (152). The lower cymbal (108) can be made of pure iron for reducing a manufacturing cost.

The second original sound generator (152) generally available on the market is made of non-magnetic material such as tin, lead, or brass. If these materials are mixed with a magnetic material such as iron, beating the first original sound generator (108) can generate sounds received by the augmented microphone (102).

A difference between the first original sound generator (108) and the second original sound generator (152) is whether magnetic material is contained therein. It is a constant concept that any drum or cymbal elements can be an original sound generator to generate an original sound. But in the case of cymbal element, it is different from the drum element. There is no structural difference except for the size of the diameters between the conventional drums and the analog electronic drum with the invention. Because the description taken in conjunction with FIG. 19, and FIGS. 33–35 is possibly concern a cymbal of the conventional drum's as the second original generator.

The augmented microphone (102) used on the structure can receive not only the beating sounds, but also all sound effects of diapasons, tones and attenuation. Namely, all of the acoustics sounds can be received.

Therefore, other sounds around the elements (101, 107), such as human sounds, will not be received, and the sounds of the elements (101, 107) are not transferred by the air but are directly received without resounds by the microphone, so that the reproduced sounds are very clear.

An analog microphone, for converting air vibrations into fluctuating currents, must be provided with a large number of components in a small space but this results in a phases problem and a complex modulating process. Using the augmented microphone (102) of the invention, the phases can be freely received without an additional modulation.

Furthermore, by using the augmented microphone (102), the sounds of the elements can be individually processed, and other effects can be added in the sounds.

As described above, the augmented microphones (102) include the single coil type and the double coil type. Of course, the element in the drum set can be provided with microphones combined with the two types.

The receiving features of the two types of augmented microphones are different. The double coil type of augmented microphone is good at receiving sounds in a wide range, and the single coil type is good at receiving trebles. Moreover, the quantity of coils can affect the volume of the sound. The coil with thin wires is advantageous to receive trebles. According to the receiving features, the augmented microphones with various type, wires, and quantities can be used for receiving trebles from the cymbal element, or basses from the bass drum element.

These augmented microphones (102) can be installed adjacent to or away from the vibration sources (103), the batter heads (101*a*), or the first original sound generator (108) of the cymbal elements for adjustment of receiving efficiency.

Referring to FIG. 19, the hi-hat cymbal has a spring (125) provided on a shaft between the second original sound generator (152) and the first original sound generator (108) with an elastic force to separate them. Sponge elastic members are provided at two ends of the spring (125) and between the two cymbals. For achieving a sufficient syntonous effect, the spring (125) can be provided with metal elements only.

A conventional hi-hat cymbal is generally provided with a single spring, for operating the spring, the spring being installed on a pedal, or inside a cymbal stand, or provided with two springs installed at left and right sides under the cymbal stand, or a single spring installed at a front side. Thus, the size and weight of the cymbal stand will be large. The hi-hat cymbal in accordance with the invention is provided with the spring (125) between the upper and lower cymbals, so that the size and weight of the cymbal stand can be reduced. Moreover, the spring (125) can also be used as a means to resonate the upper and lower cymbals.

As illustrated, the hi-hat cymbal (107) is mounted on a main stand (127) and can be adjusted by a secondary stand (126). The hi-hat cymbal (107) needs a sufficient length from the secondary stand (126) to the main stand (127) to position the spring (125) between the lower and upper cymbals. A cable (128) is extended from a bottom of the secondary stand (126) and attached to a ring on a pedal (113) for operating the hi-hat cymbal. The setting of the pedal (113) and cymbal can be done by one touch.

In this embodiment, the main stand (127) is integrally mounted on a base plate (129) of the pedal (113).

The main stand (127) is directly secured in the base plate (129) of the pedal (113), and further fastened by a linkage (130) to prevent the pedal (113) from displacing from the cymbals.

Figure 20:
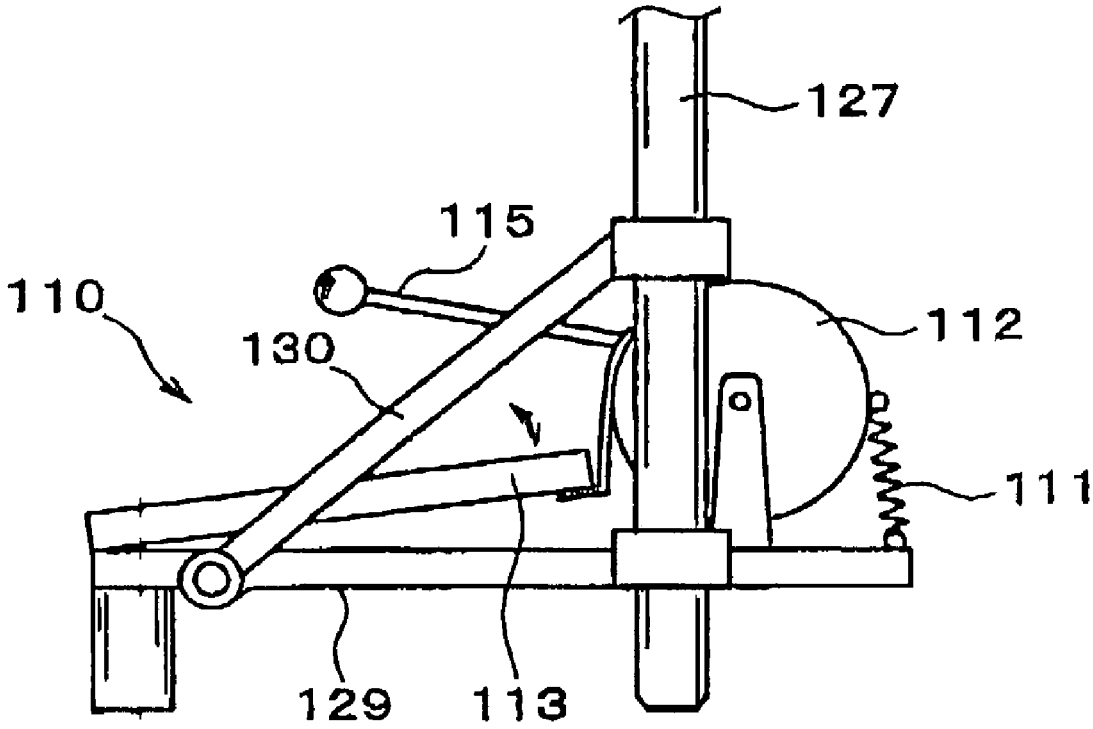
FIG. 20 is a schematic view of another embodiment of the pedal assembly for the bass drum element in accordance with the invention.

As shown in FIG. 20, the structure of the pedal (113) integrated with the main stand (127) is applicable to the pedal assembly (110) for the bass drum element as shown in FIG. 8 and FIG. 30. The structure of the pedal assembly (110) secured with the main stand (127) will be illustrated in FIG. 27, as described above, integrally mounted with the main stand (127), the pedal assembly (116) will not displace during performance.

Figure 27:
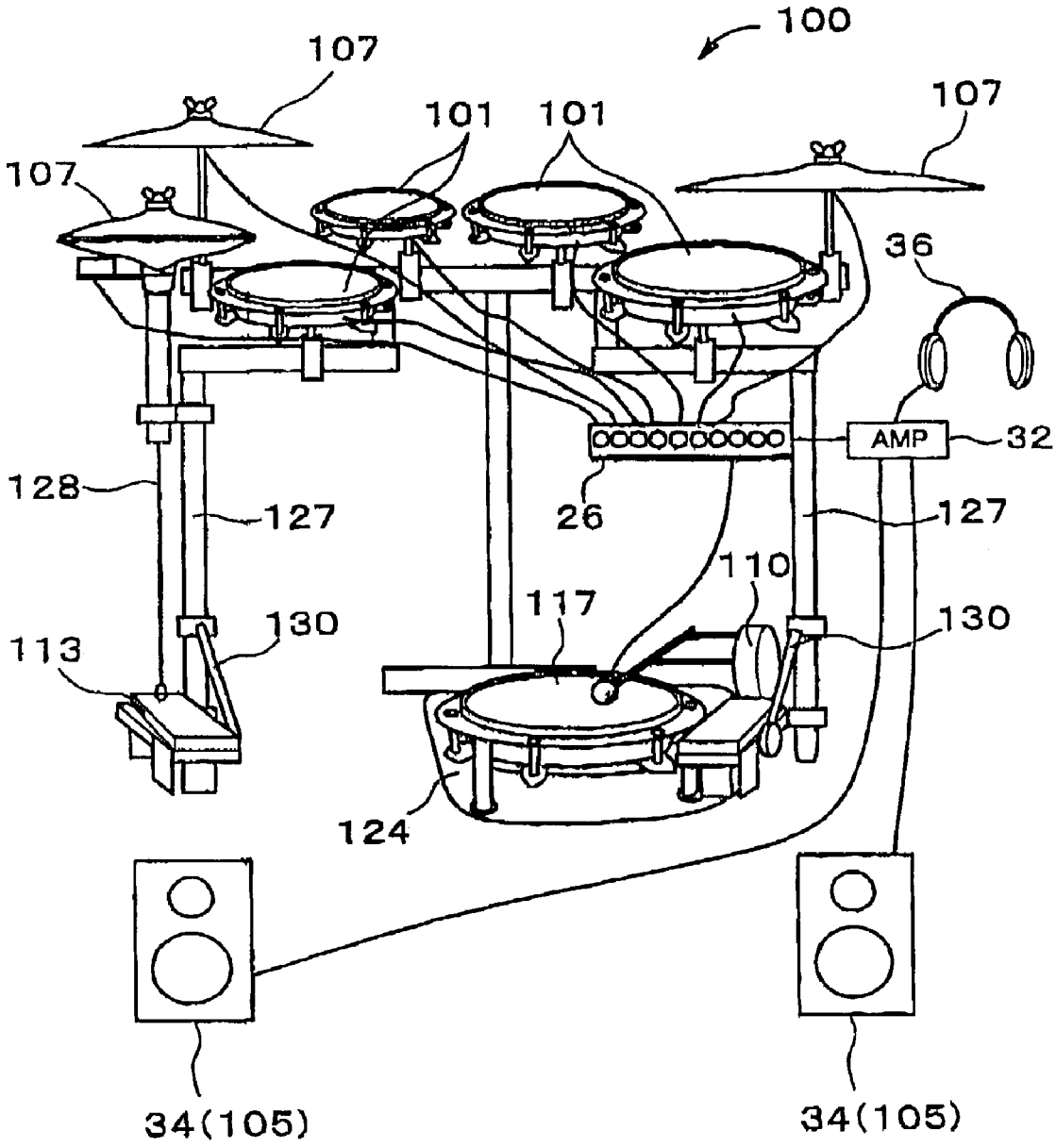
FIG. 27 is a schematic perspective view of an embodiment of the drum set in accordance with the invention.
Figure 28:
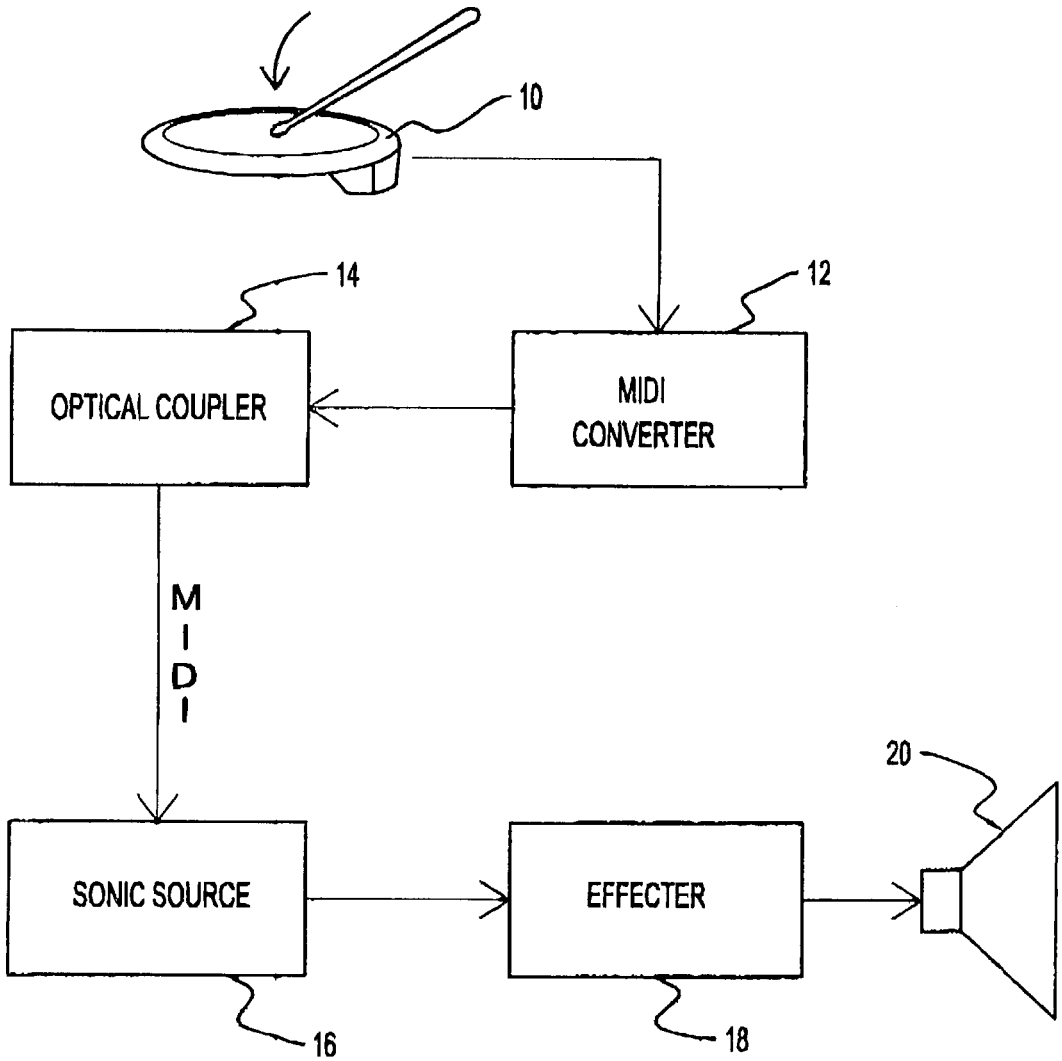
FIG.28 PRIOR ART
FIG. 28 is a schismatic view of a conventional electronic drum set.

The main stand (127) for the pedal assembly (110) can be an integral part for the drum and cymbal elements, as shown in FIG. 27, or a separate part especially used for the pedal assembly (110).

Figure 21:
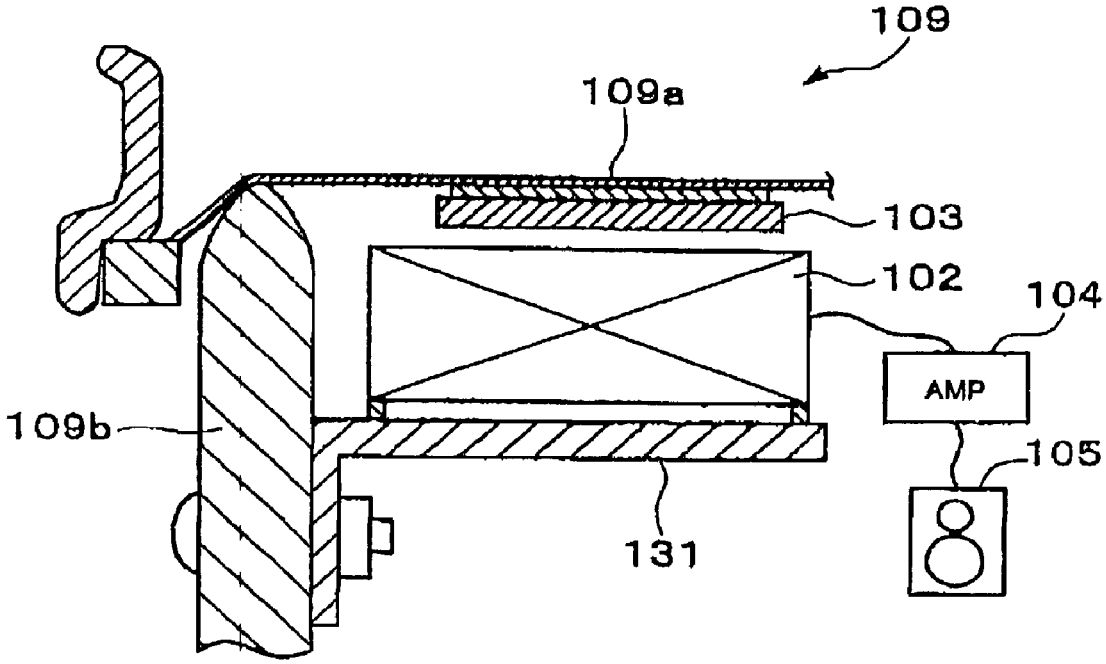
FIG. 21 is a cross-sectional view showing a means to install the augmented microphone in a conventional drum element.

The means to install the augmented microphone (102) can be used for the conventional drum set and the percussion instruments as described above. Referring to FIG. 21 corresponding to FIG. 16, the conventional drum element (the second original sound generator) has a hollow resonator defined between the batter head (109*a*) and the shell (109*b*). The vibration source (103) is adhered to an inner surface of the batter head (109*a*), and the augmented microphone (102) is installed on a plate (131) inside the shell (109*b*). The sounds are received by the augmented microphone (102), amplified by the amplifier (104), and reproduced by the speakers (105) to output. Thus, in a live music performance, there are sufficient volumes of sounds for audiences. The augmented microphone (102) can be installed adjacent to or away from the batter heads (109*a*).

Similarly, the means in FIGS. 17, 18, and FIGS. 33–35 are applicable to the conventional drum set for cymbal elements, the first original sound generators can be metal disks made of magnetic material, and the second original sound generators can be non-magnetic cymbals available on the market, or be made of the same non-magnetic materials.

Figure 33:
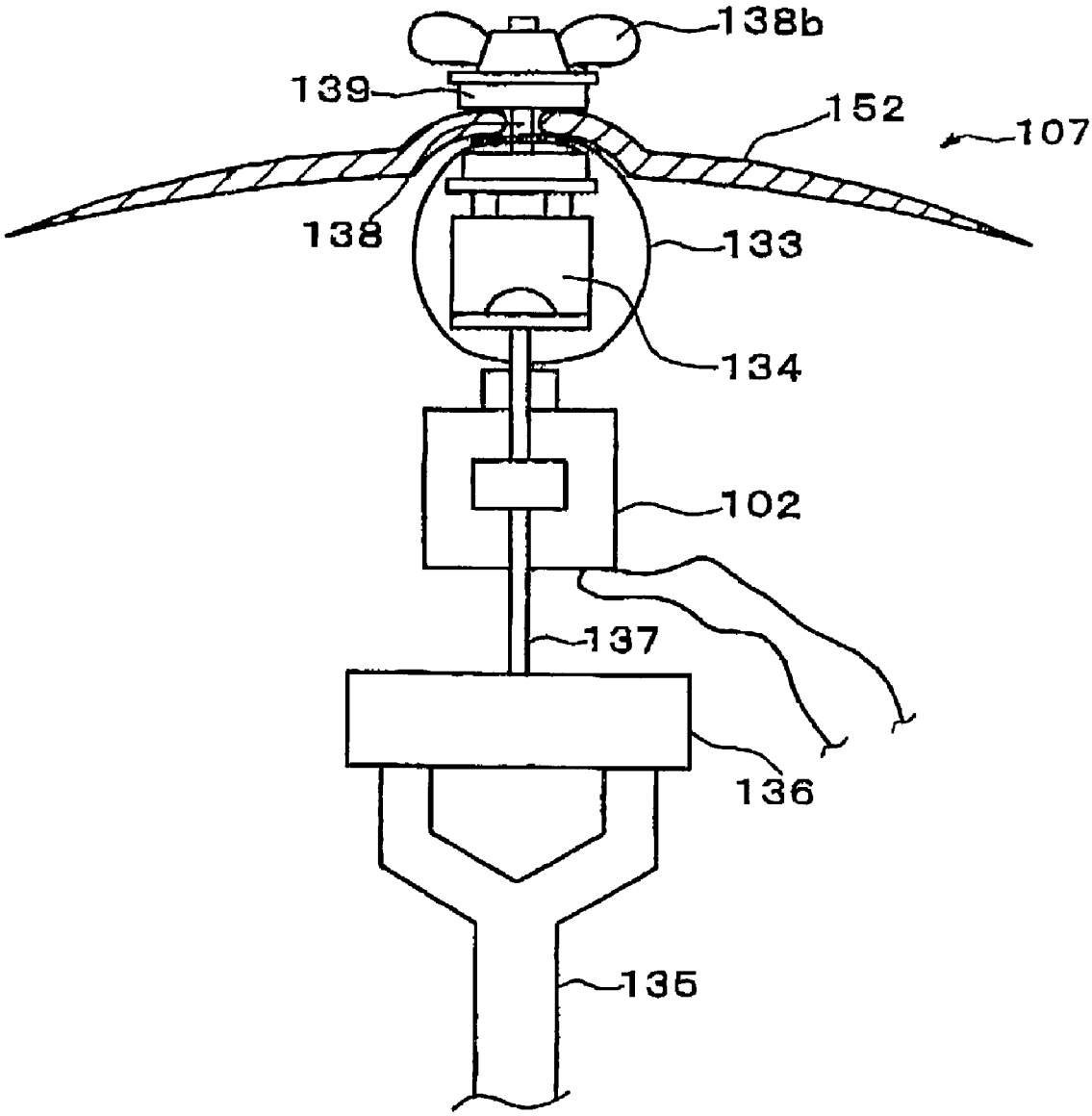
FIG. 33 is a cross-sectional view of another embodiment of the augmented microphone installed or a cymbal element in accordance with the invention.
Figure 34:
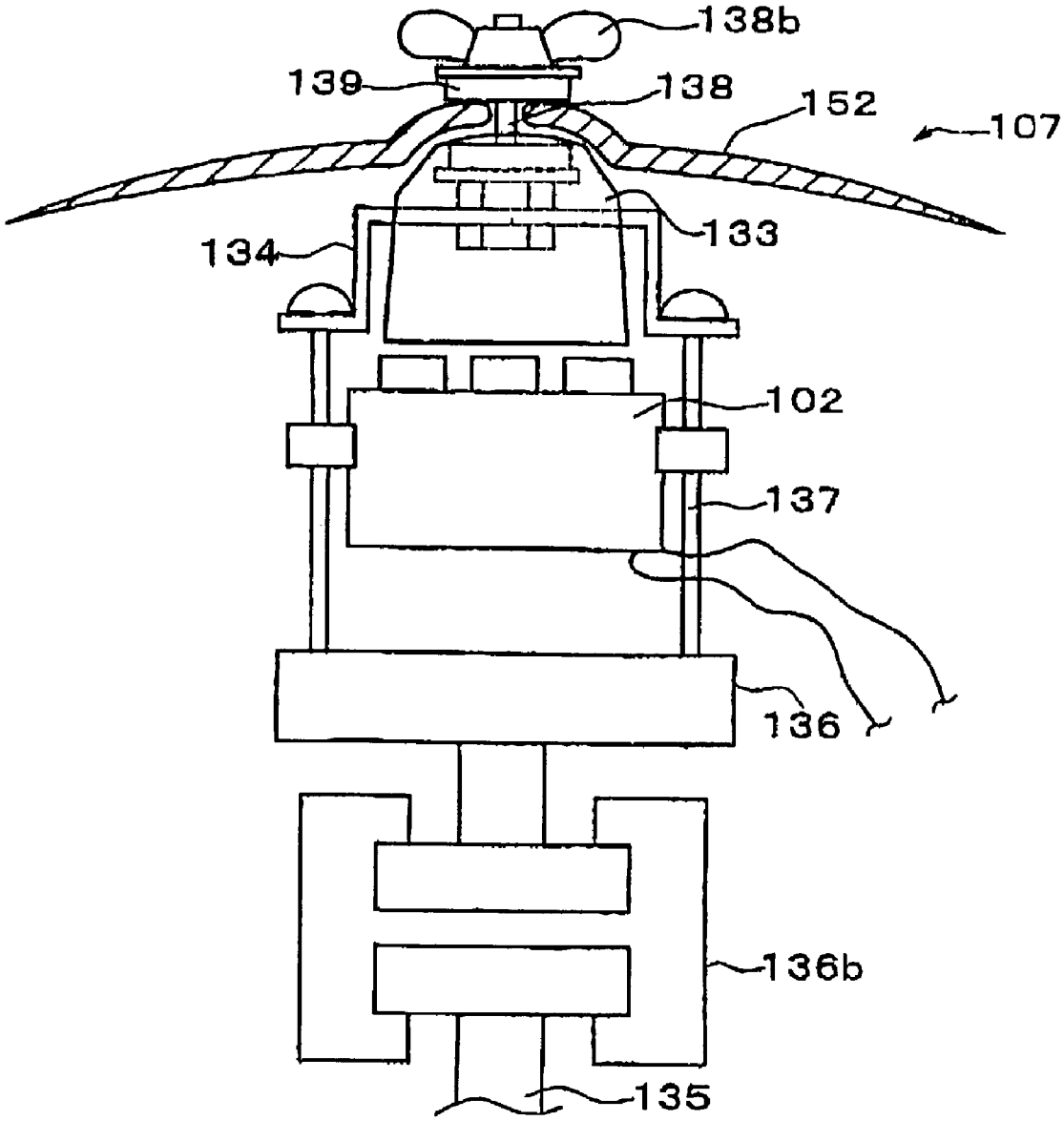
FIG. 34 is a side view of FIG. 33.

Another embodiment of the augmented microphone installed on the cymbal elements is illustrated in FIGS. 33–35.

The first original sound generator (108) made of magnetic material may change tone colors of the sounds. However, it is very expensive to develop a magnetic material which will not change the tone colors.

Therefore, it is expected that the cymbals available on the market can be used with the augmented microphone to receive the sounds.

In view of this point, the means illustrated in FIGS. 33 and 34 includes a second original sound generator (152) without metal magnetic material, a syntonous magnetic piece (Vibration source) (133) made from a metal sheet, which can vibrate along with the second original sound generator (152), and an augmented microphone (102) to electrically amplify the vibrations of the syntonous magnetic piece (133). A rubber piece (136) and a shockproof piece (136*b*) are provided between the augmented microphone (102) and a stand member (135) to prevent vibrations of other elements from transferring to the syntonous magnetic piece (133) through the stand member (135).

The shockproof piece (136*b*) provided between the sound generator and the stand member ensures that the original sounds generated by the elements can be purely received by the augmented microphone, which is applicable to other elements.

The augmented microphone (102) is mounted on a supporting member (137) extending from the rubber piece (136). A reversed U-like plate (134) is provided at a top end of the supporting member (137), and an adjusting bolt (138) is provided on the reversed U-like plate (134) and extends through the second original sound generator (152). A first sponge (139) is provided above the second original sound generator (152), and a second sponge (139) is provided at a bottom of the adjusting bolt (138).

Figure 35A:
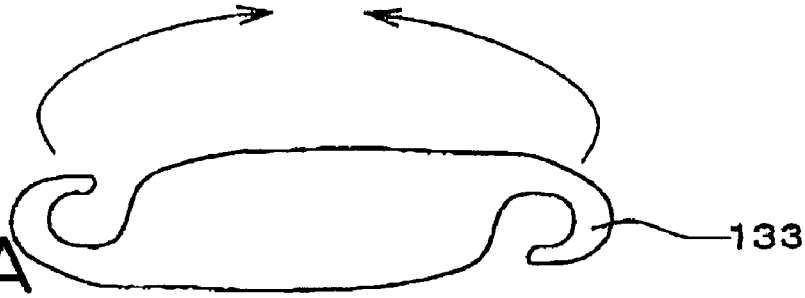
FIGS. 35A to C are schematic views of a syntonous magnetic piece of FIG. 34.

Referring to FIG. 35*a*, the syntonous magnetic piece (133) has two hooked ends.

Figure 35B:
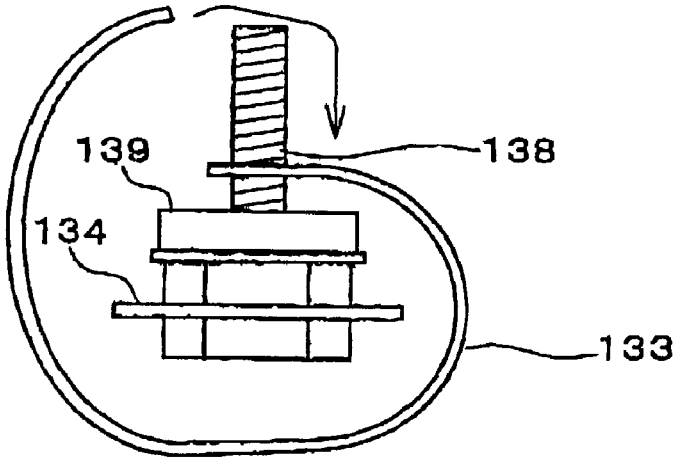
Figure 35C:
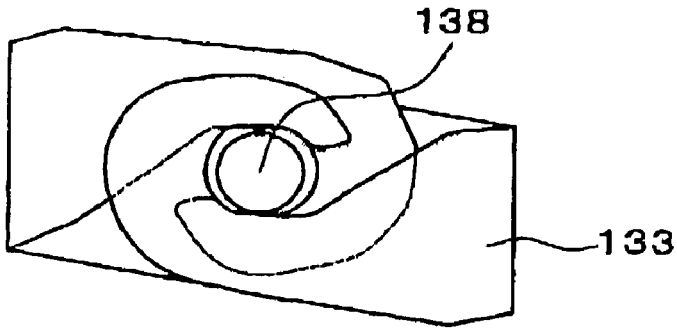

As shown in FIG. 35*b*, the syntonous magnetic piece (133) is deformed to enclose the reversed U-like plate (134) under the adjusting bolt (138) and the sponge (139) at the bottom of the adjusting bolt (138) with the hooked ends attached to the adjusting bolt (138). Viewed from the top, as shown in FIG. 35*c*, the hooked ends of the syntonous magnetic piece (133) are attached to the adjusting bolt (138) and with each other. By this means, the syntonous magnetic piece (133) is connected with the second original sound generator (152) by the adjusting bolt (138) extending through the second original sound generator (152). Thus, the second original sound generator (152) can be fastened by a nut (138*b*) (as shown in FIG. 34) engaged with the adjusting bolt (138).

Therefore, the second original sound generator (152) directly connected with the syntonous magnetic piece (133) does not need other means to be installed therewith to prevent attenuation of sound. The vibration of the cymbal element can resonate the syntonous magnetic piece (133) to generate induced currents in the augmented microphone (102). Therefore, without through vibration of air, the treble sounds of the cymbal can be directly received by the augmented microphone (102).

The syntonous magnetic piece made from the metal sheet is also applicable to the drum elements.

Figure 36:
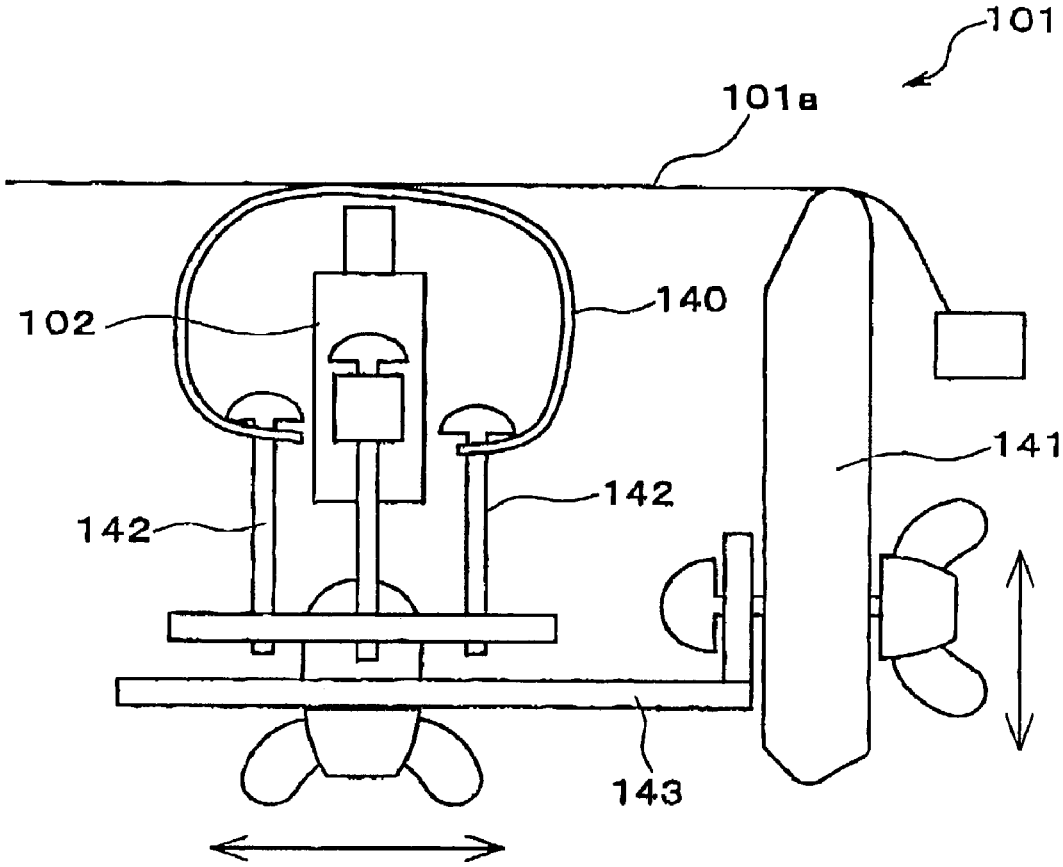
FIG. 36 is a schematic view of another embodiment of the augmented microphone installed in a drum element in accordance with the invention.
Figure 37:
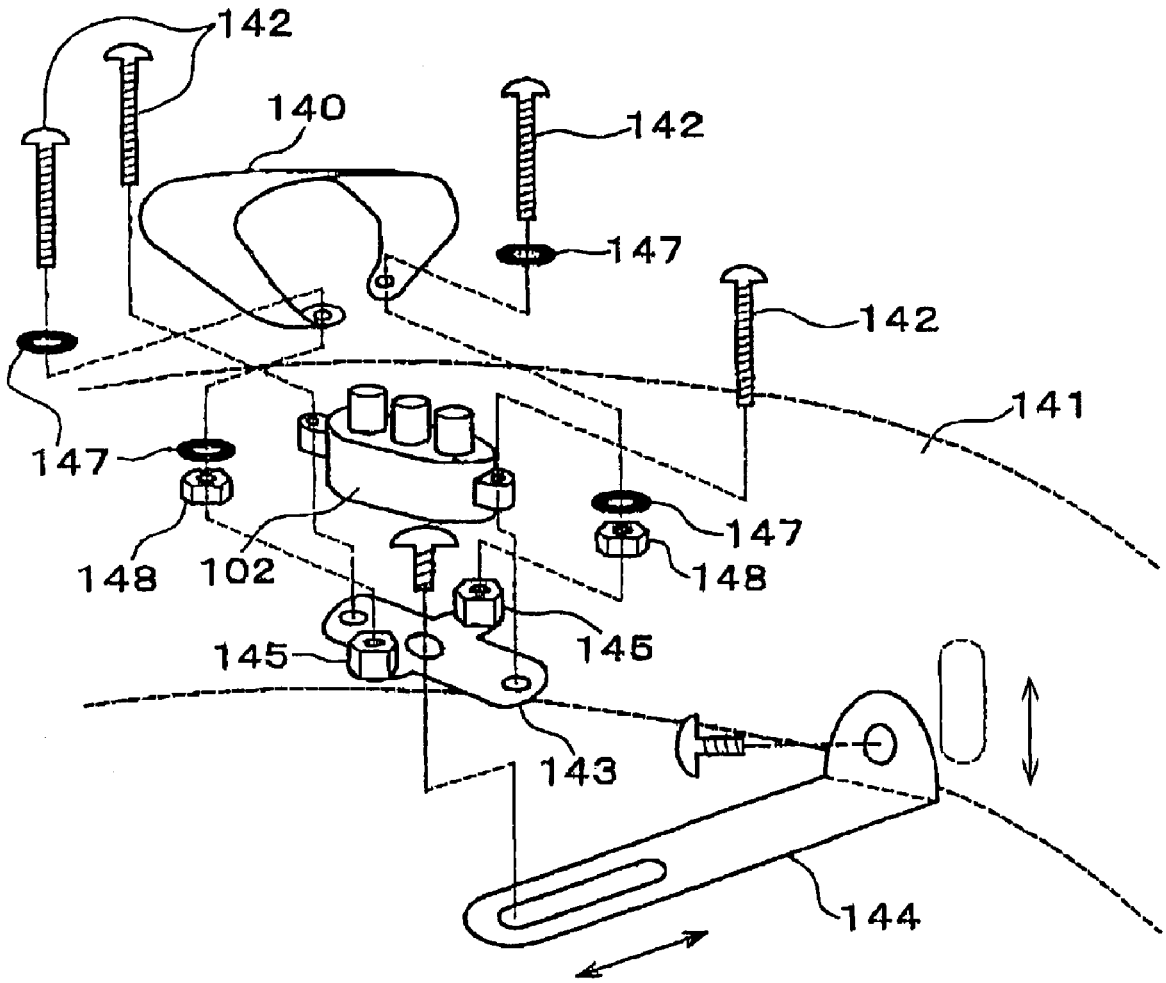
FIG. 37 is an exploded perspective view of the device in FIG. 36.

Another embodiment of the means to install the augmented microphone in the drum element (101, 117) is illustrated in FIG. 36. FIG. 37 is an exploded perspective view of FIG. 36.

Referring to FIG. 37, an annular syntonous magnetic piece (vibration source) (140) has two apertures, and two threaded fasteners (142) are respectively extended through the apertures. An augmented microphone (102) enclosed by the syntonous magnetic piece (140) also has a threaded fastener (142) extended therethrough. The annular syntonous magnetic piece (140) and the augmented microphone (102) are secured on a seat (143) by the threaded fasteners (142). The seat (143), which is movable in a direction parallel to the batter head (101*a*), is mounted on an L-like arm (144) fastened in a shell (141) of the drum element (101). The L-like arm (144) is adjustable in the vertical direction to abut the syntonous magnetic piece (140) to the inner surface of the batter head (101*a*) under a certain pressure.

Therefore, similar to the means illustrated in FIG. 17, beating the batter head (101*a*) can vibrate the syntonous magnetic piece (140), and the vibration can be received by the augmented microphone (102).

In addition, the seat (143) is movable in the area, in which distances from the side opposite to the performer (P) towards the center (C) of the batter head (101*a*) are between 20–45% of the radius, as shown in FIG. 31.

Figure 38:
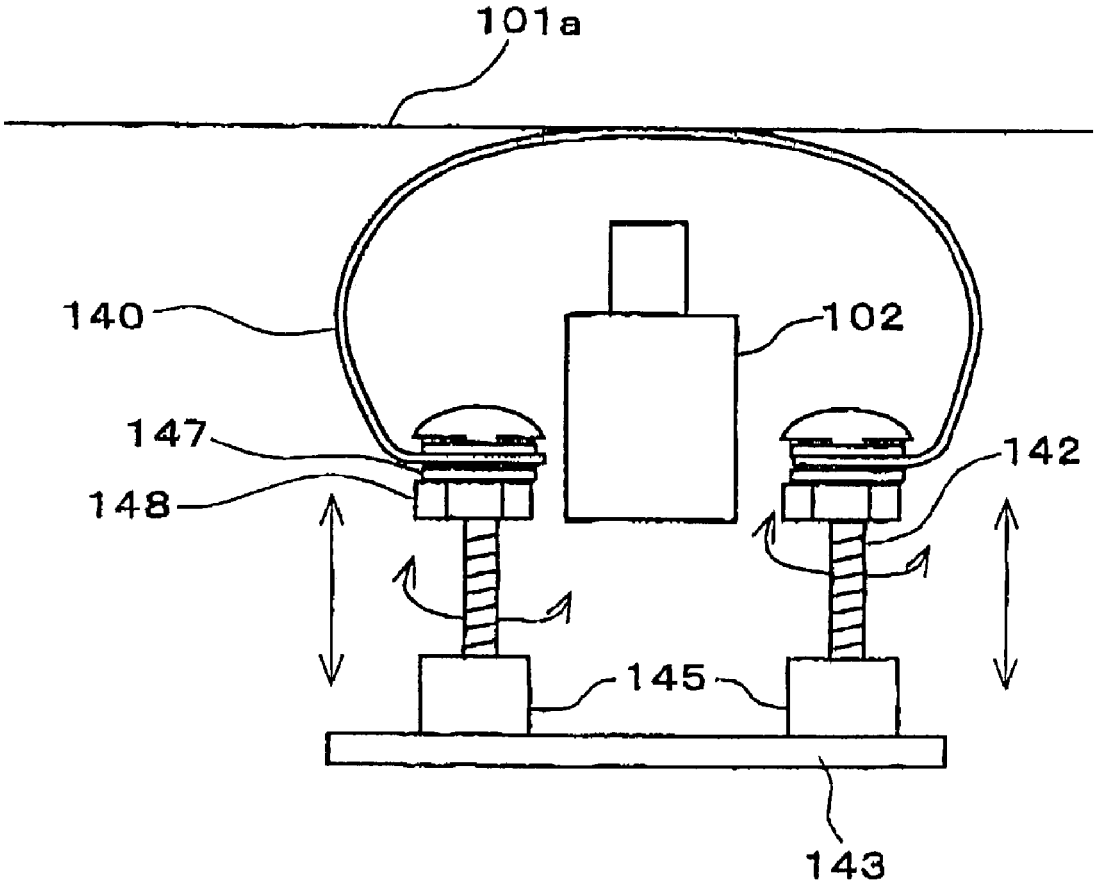
FIG. 38 is a schematic view of another embodiment of the augmented microphone installed in a drum element in accordance with the invention.
Figure 41:
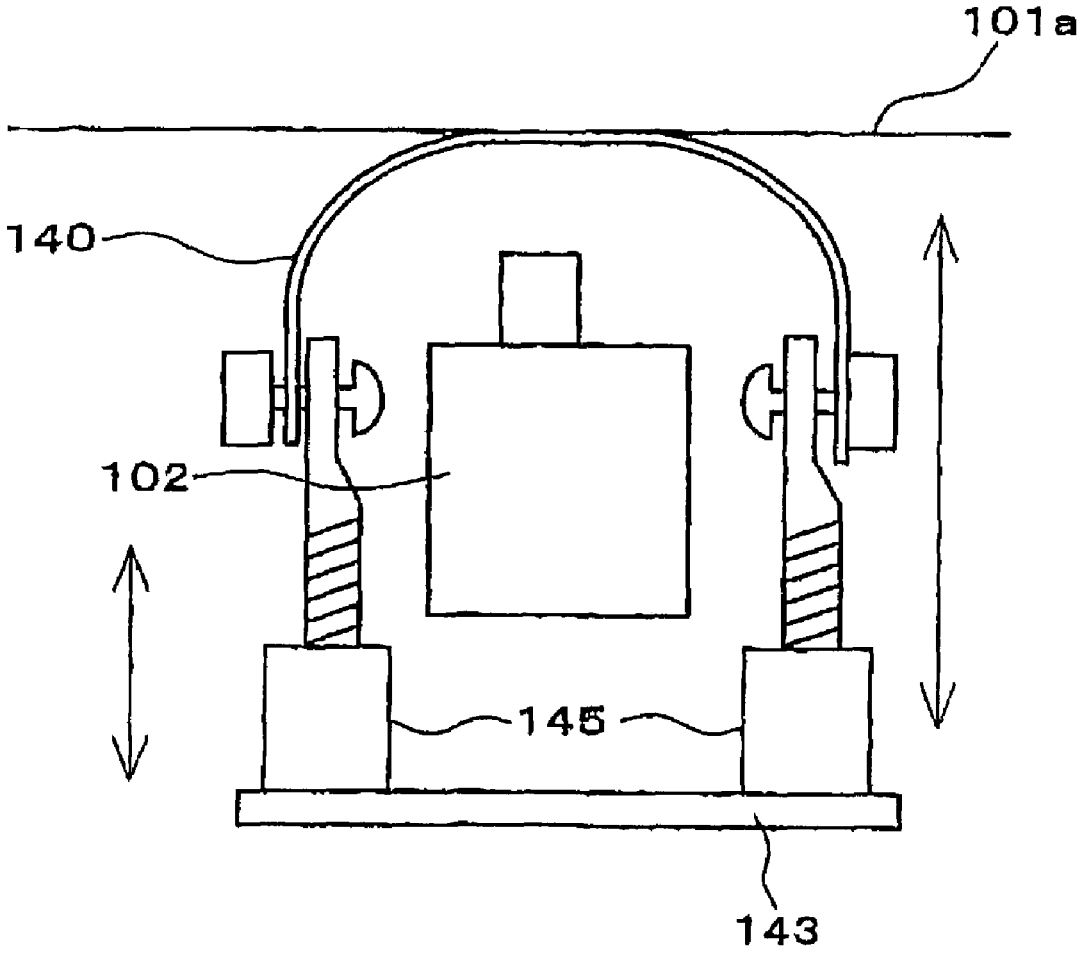
FIG. 41 is a schematic view of a further embodiment of the augmented microphone installed in a drum element in accordance with the invention.
Figure 42:
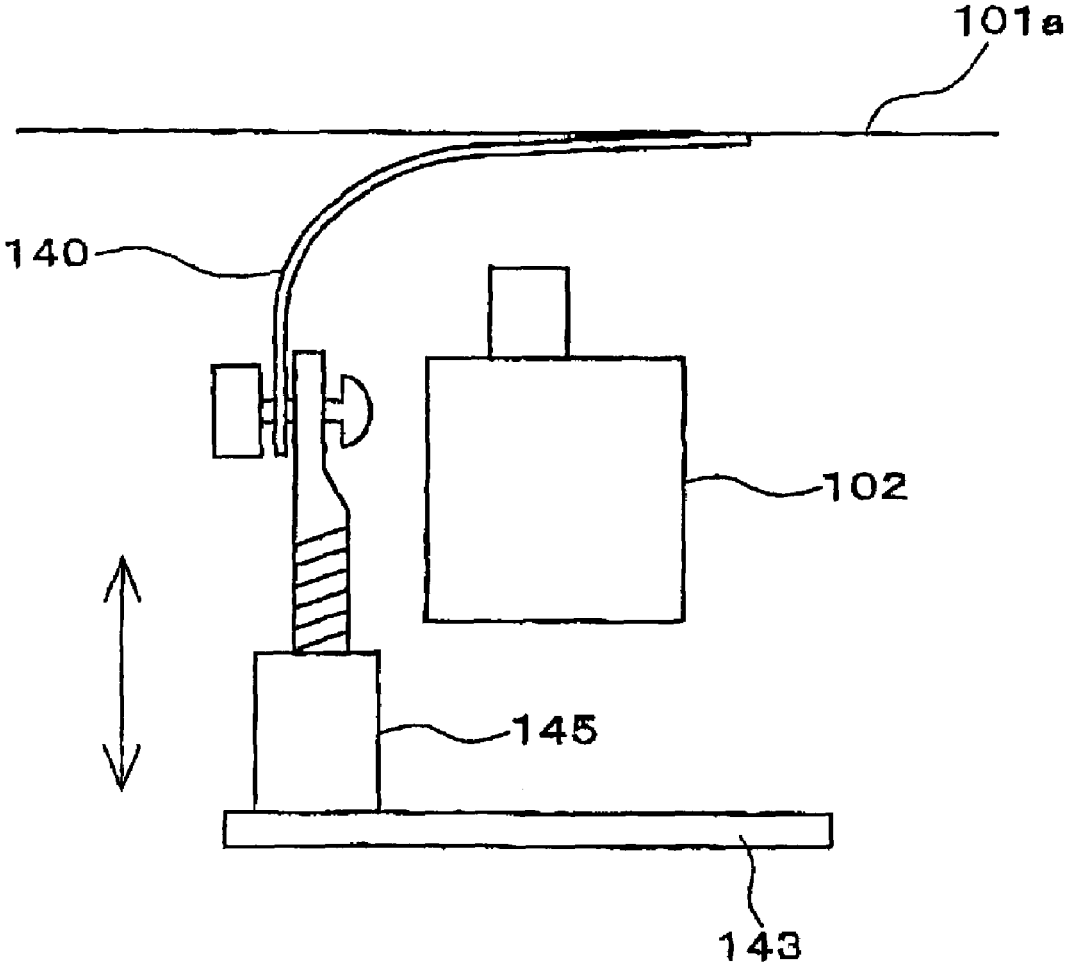
FIG. 42 is a schematic view of a further embodiment of the augmented microphone installed in a drum element in accordance with the invention.

Referring to FIGS. 38, 41, and 42, flanges (145) are formed on the seat (143). Tightening/loosening the threaded fasteners (142) in/from the flanges (145) can adjust the pressure between the syntonous magnetic piece (140) and the batter head (101*a*), and the distance between the augmented microphone (102) and the batter head (101*a*).

Figure 39:
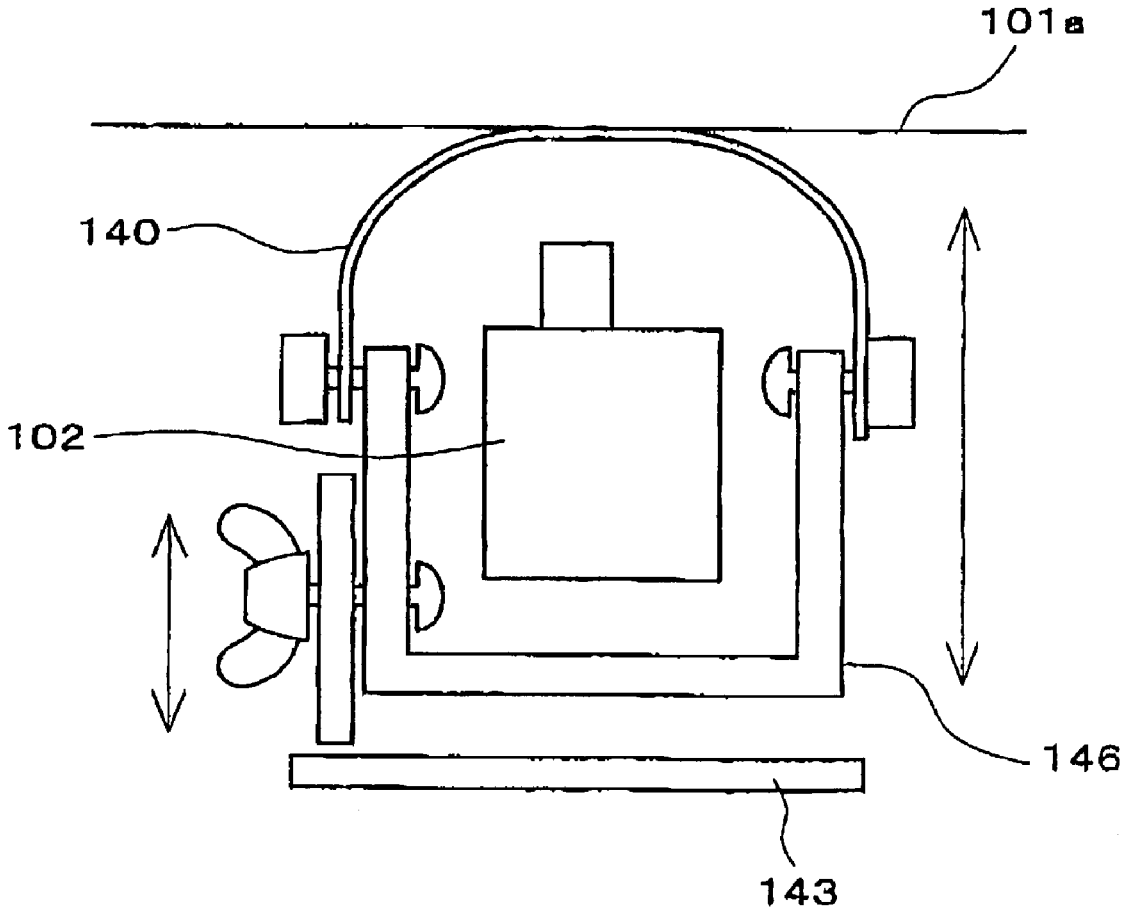
FIG. 39 is a schematic view of a further embodiment of the augmented microphone installed in a drum element in accordance with the invention.
Figure 40:
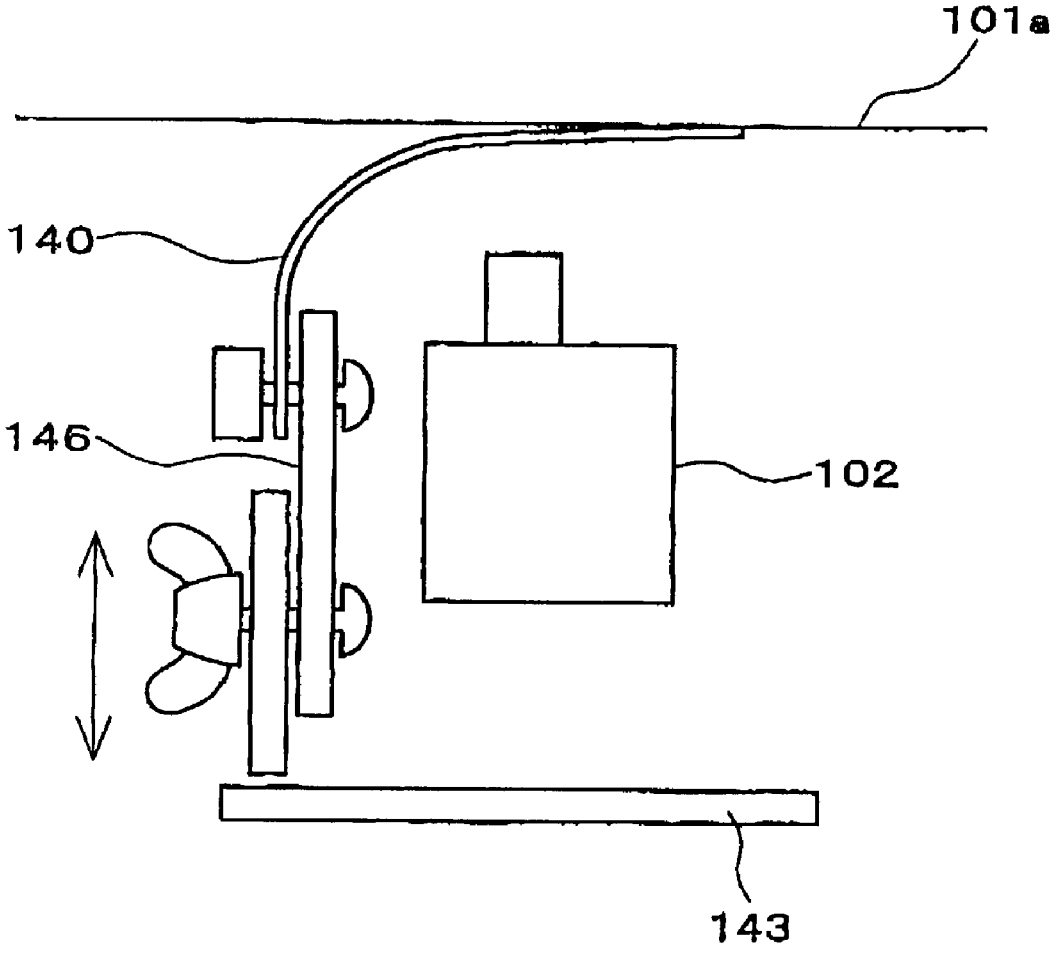
FIG. 40 is a schematic view of another embodiment of the augmented microphone installed in a drum element in accordance with the invention.

The adjustments for pressure and distance are illustrated in FIGS. 39 and 40. The syntonous magnetic piece (140) is mounted on a supporting seat (146), and the supporting seat (146) is mounted on the seat (143) which is adjustable to change the distance to the batter head (101*a*).

Referring to FIGS. 36, 38–42, the syntonous magnetic piece (140) can be formed with an annular shape (as shown in FIGS. 36 and 38), or an arch shape (as shown in FIGS. 39 and 41), or a parabola shape with a fixed end (as shown in FIGS. 40 and 42).

All of these shapes are "the form that utilize flexibility". And by these forms of the magnetic pieces can prevent the magnetic piece from separating from the batter head under impacts of beatings, and can be finely adjusted without damaging the batter head.

In the embodiments as described above, although the syntonous magnetic pieces (133, 140) are made from a metal sheet, they also can be made of other board materials that have magnetic components and can be easily resonated, such as magnetic steel sheets or magnetic membrane materials.

The metal sheet, which is good at transferring trebles, can be used as a magnetic piece for the snare drum and the cymbal elements. The steel sheet, which is good at transferring mediants and basses and has a good elasticity, is advantageous to beating amplitudes and attenuation of the drum elements. Therefore, the elements provided with various magnetic pieces can represent a creativity of the performer very well.

Moreover, referring to FIGS. 37 and 38, in order to facilitate vibration of the syntonous magnetic pieces (140), absorbers (147), such as sponges or rubbers, are provided on the threaded fasteners (142) and the nut (148). The absorbers can also be used in means as shown in FIGS. 38–42.

As illustrated, the analog electronic drum set can be grouped under three groups: a metal instrument group including the right cymbal (R.C.), the left cymbal (L.C.) and the hi-hat cymbal (H.H.), a rhythm drum group including the bass drum (B.D.) and the snare drum (S.D.), and an ornament drum group including the high tom-tom, the middle tom-tom, and the low tom-tom (H.T., M.T., L.T.). The sounds of these groups are processed with modulating effects, dimensional effects and ornamental effects. The processed data are saved and can be used for modulating every melody performed by the analog drum set. The sound modulator (26) can be connected with their elements by a plurality of cables or a single IEEE 1394 cable.

Figure 23:
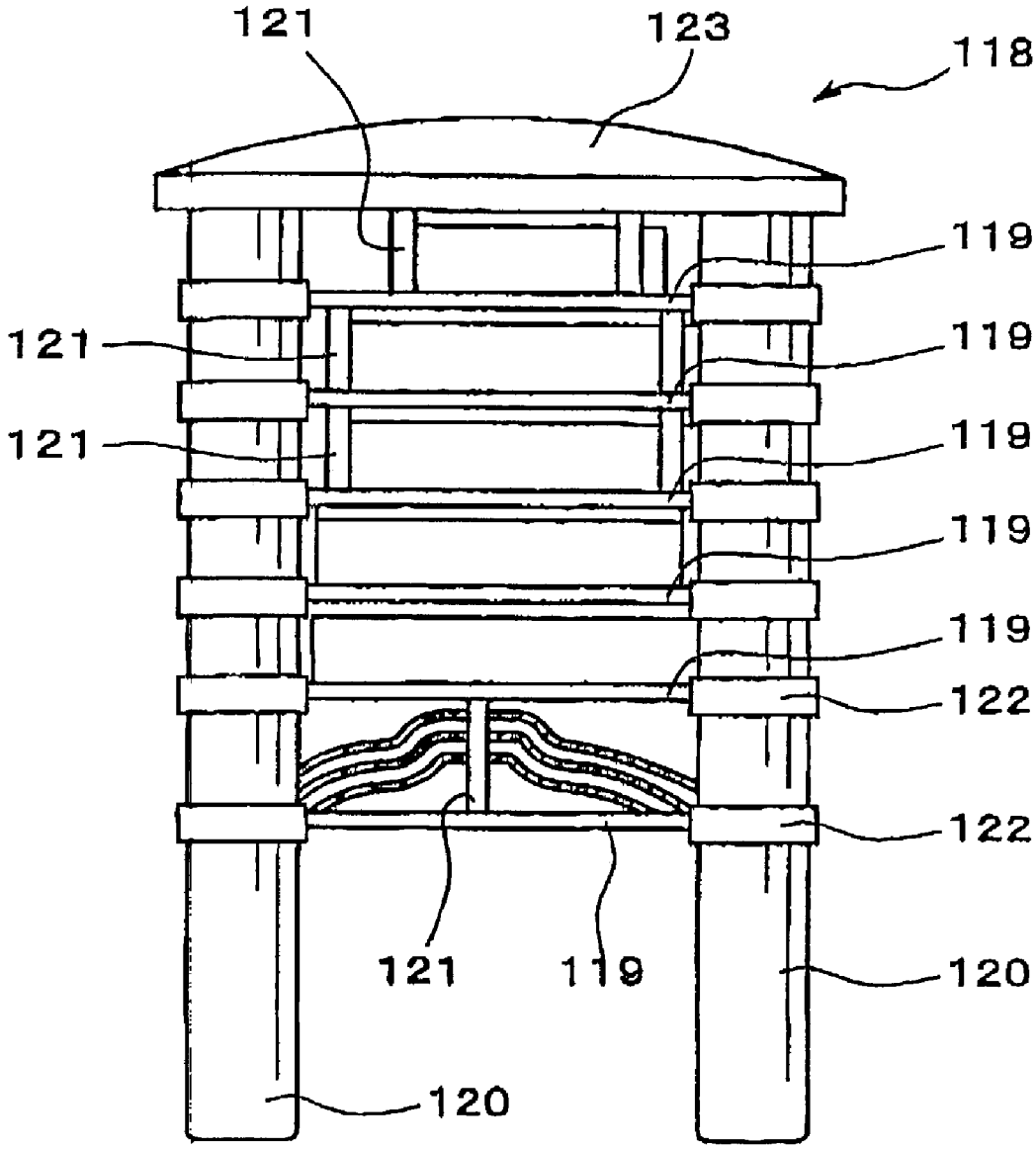
FIG. 23 is a schematic view of a container for storing the drum elements and the cymbal elements and used as a chair.

A container for storing the drum elements and the cymbal elements of the analog drum set is illustrated in FIG. 23, and can be used as a chair for the performer.

Figure 22:
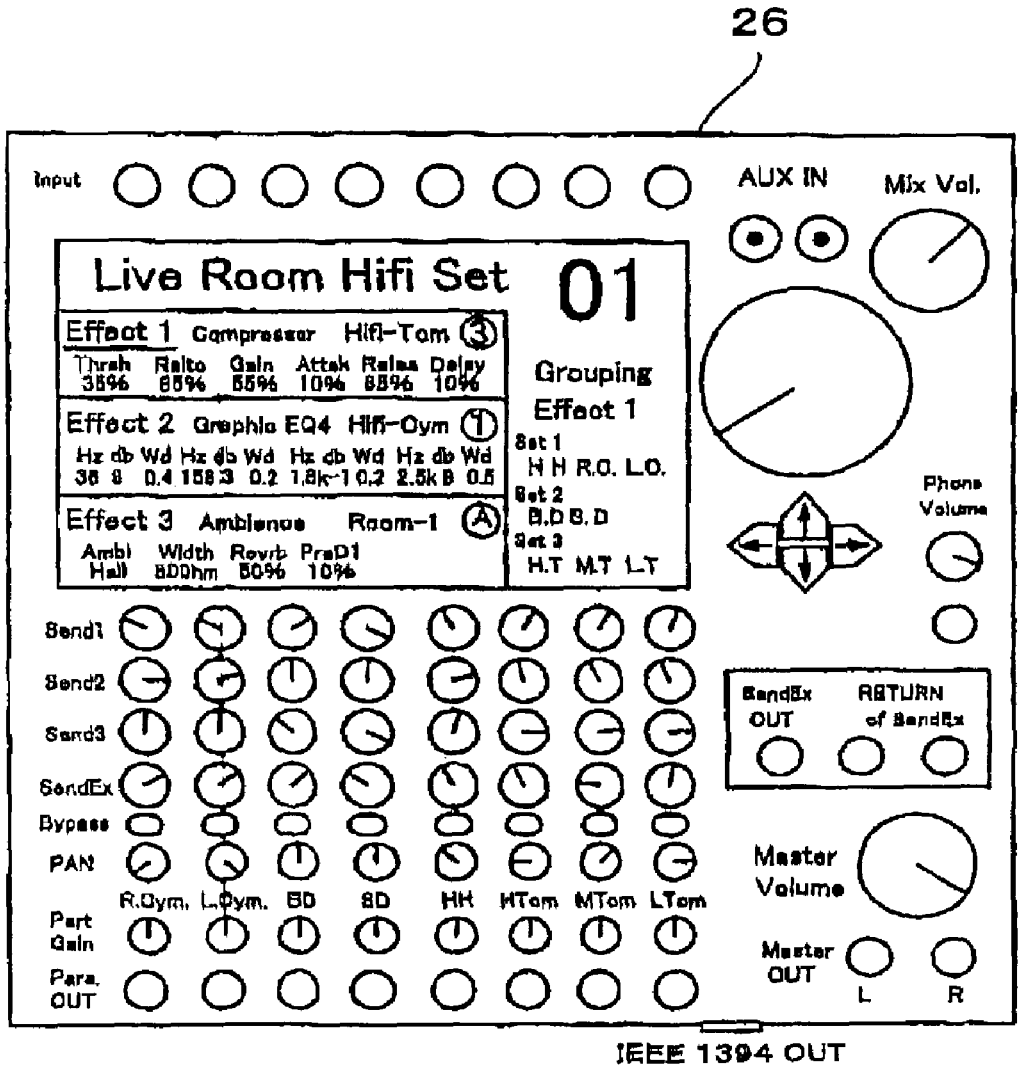
FIG. 22 is a schematic view or a panel of a sound modulator in accordance with the invention.

Another embodiment of the panel of sound modulator (26) is shown in FIG. 22. The container (118) has a plurality of boards (119) spaced and stacked on a plurality of (three in this embodiment) legs (120). A plurality of bars (121) is provided between the boards (119) to space apart the boards (119) for receiving the elements.

Figure 24:
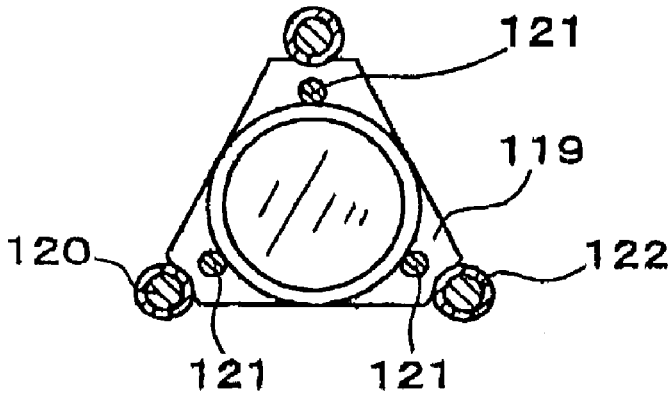
FIG. 24 is a schematic top view showing a snare drum element received in the container of FIG. 23.
Figure 25:
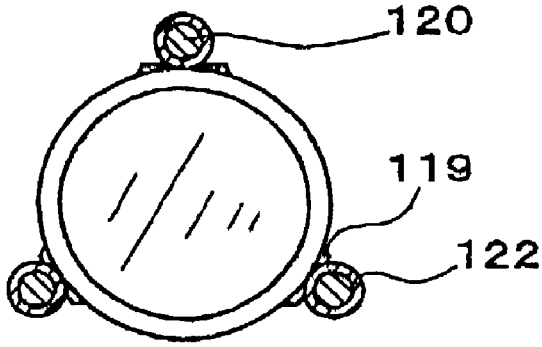
FIG. 25 is a schematic top view showing a bass drum element received in the container of FIG. 23.
Figure 26:
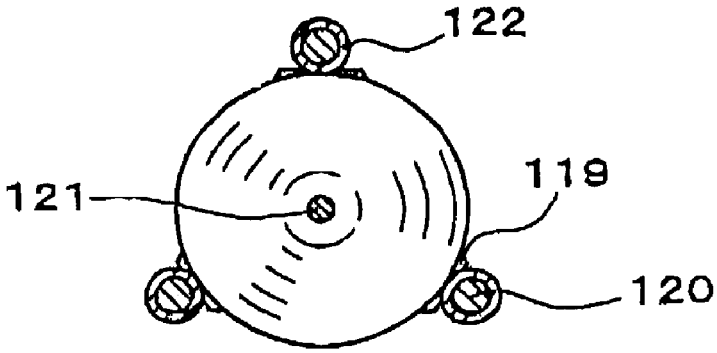
FIG. 26 is a schematic top view showing a cymbal element received in the container of FIG. 23.

Referring to FIGS. 24-26, each of the boards (119) has a plurality of ring parts (122), for the legs (120) respectively extending through the ring parts (122). When the elements are received between the boards (119) and positioned by the bars (121), the legs (120) can be extended through the ring parts (122) to construct the container (118) as shown in FIG. 23 for storing and carrying these elements. FIG. 24 illustrates the small drum, such as the snare drum or the tom-tom, fixed in the container. FIG. 25 illustrates the large drum, such as the bass drum, fixed in the container. FIG. 26 illustrates the cymbal element fixed in the container.

Figure 43:
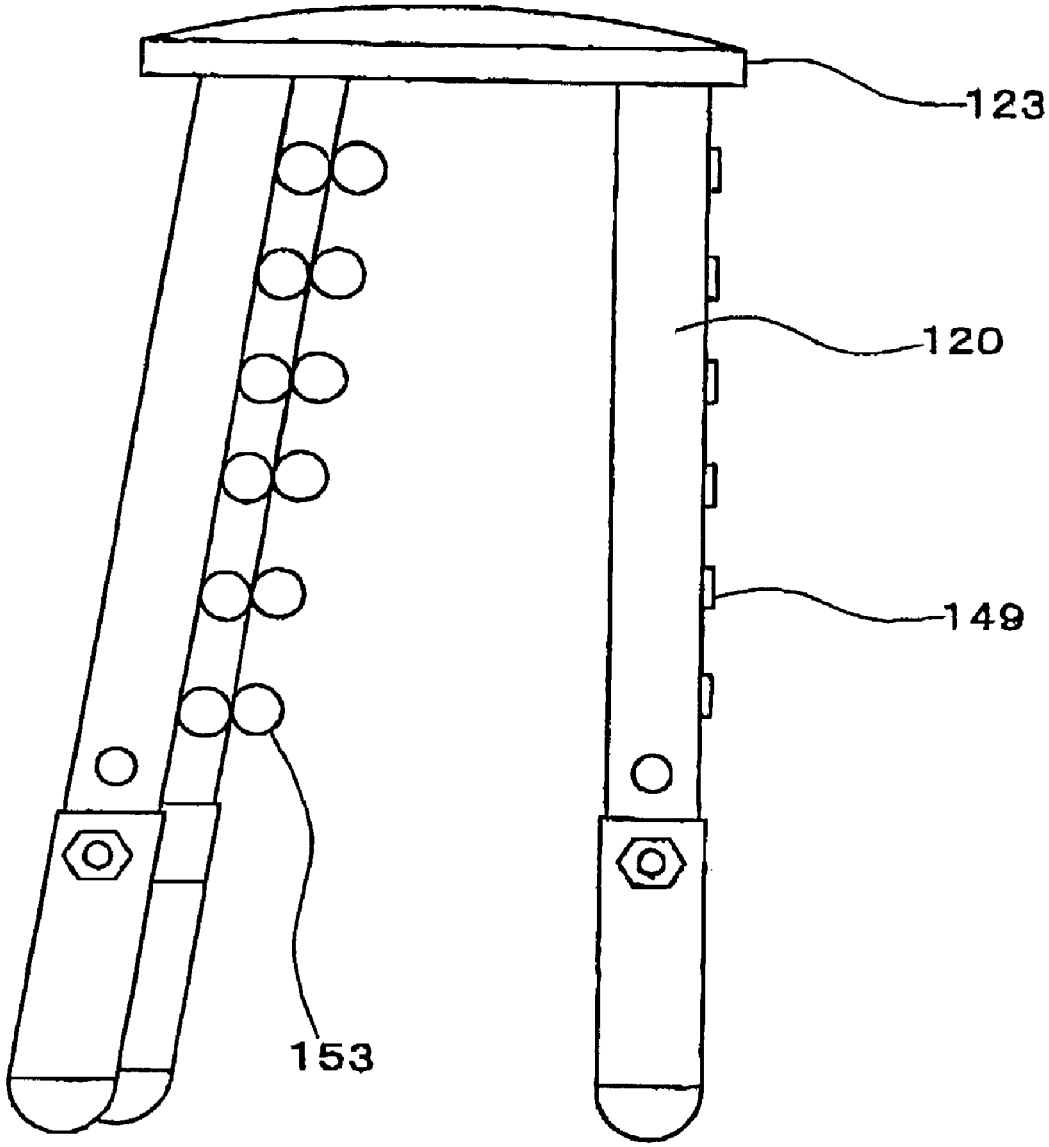
FIG. 43 is a schematic view of another embodiment of the container for storing the drum elements and he cymbal elements and used as a chair.
Figure 44:
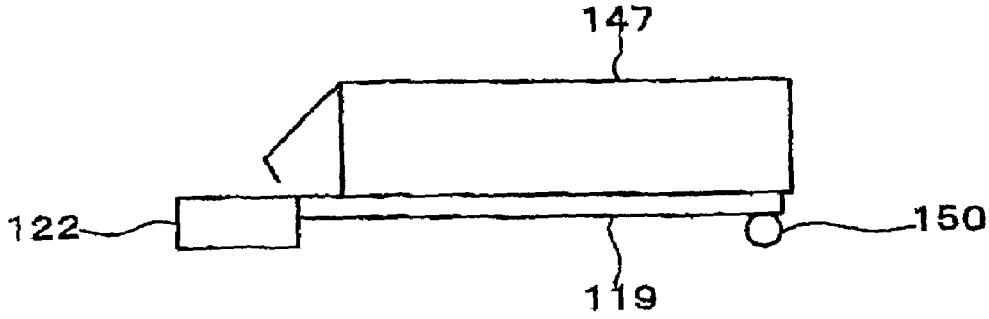
FIG. 44 is a schematic view of a board and a box disposed on the board of the container of FIG. 43.
Figure 45:
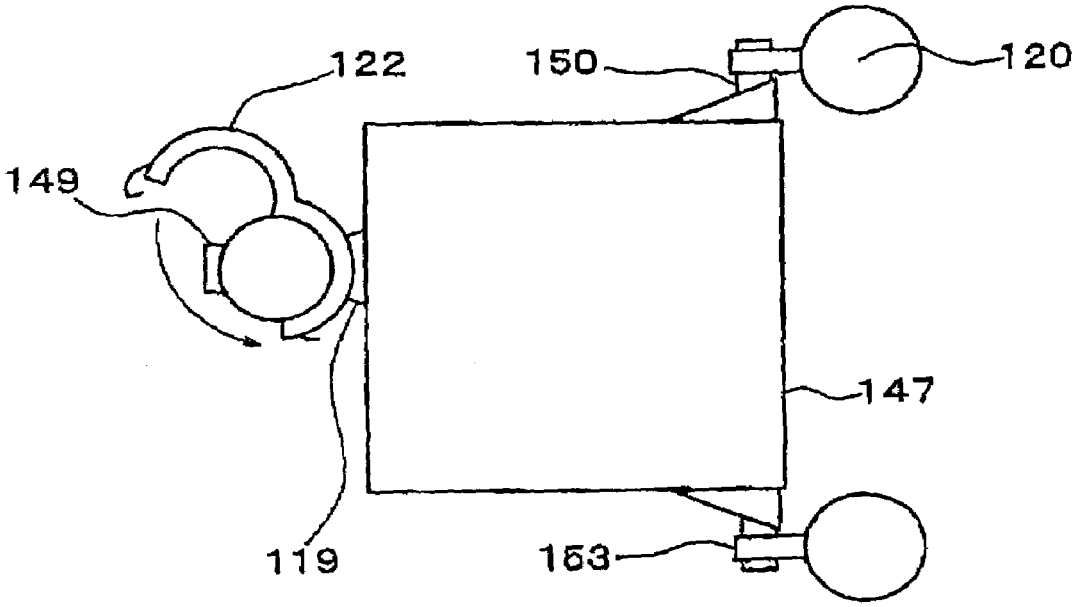
FIG. 45 is a top view of FIG. 44.

Another embodiment of the container to store the elements of the analog electronic drum set is illustrated in FIGS. 43–45.

Referring to FIG. 43, the container has three legs (120), wherein two of the legs (120) each have a plurality of ring members (153), and the remaining leg (120) has a plurality of fastening members (149) corresponding to the ring members (153). As shown in FIGS. 44 and 45, soft boxes (147) to receive the drums and cymbals are disposed on the boards (119). The boards (119) each have two pins (150) respectively inserted in the corresponding ring members (153), and an open ring (122) formed at a side opposite to the pins (150) to attach the fastening members (149).

When the open ring (122) is detached from the fastening members (149), the board (119) can be pivoted about the pins (150), and the elements can be quickly taken in and out from the container.

The container can have four legs (120), wherein two legs (120) are provided with the ring members (153), and the other legs (120) are provided with the fastening members (149). Thus, the board (119) has two open rings (122) to attach the respective fastening members (149).

The analog electronic drum set as described above is illustrated in FIG. 27.

In the analog electronic drum set shown in FIG. 27, the first tom-tom is 6 inches (15.24 cm) in diameter (size), the second tom-tom is 8 inches (20.32 cm) in diameter, the third tom-tom is 10 inches (25.4 cm), the bass drum is 12–14 inches (30.48–35.56 cm) in diameter, the snare drum is 8 inches (20.32 cm) in diameter, the hi-hat cymbal is 6–8 inches (15.24–20.32 cm) in diameter, the first cymbal is 8–10 inches (20.32–25.4 cm) in diameter, and the second cymbal is 10–12 inches (25.4–30.48 cm) in diameter. On the other hand, in the conventional drum set available on the market, the tom-toms are 12, 13, 16 inches (30.48, 33.02, 40.64 cm) in diameters, the bass drum is 22 inches (55.88 cm) in diameter, the snare drum is 14 inches (35.56 cm) in diameter, the hi-hat cymbal is 14 inches (35.56 cm) in diameter, the first cymbal is 16–18 inches (40.64–45.72 cm) in diameter, and the second cymbal is 20–22 inches (50.8–55.88 cm) in diameter. Therefore, the sizes of the all elements of the invention are obviously lower than those of the conventional drum set. However, the original sound generators of the analog electronic drum set will not be limited in the sizes mentioned above.

In the embodiments as described above, the container for the analog electronic drum set can store all of the drum elements and the cymbal elements. However, the container can be designed as a configuration to store any one of these elements, or to store the sound modulator (26).

In the embodiment as shown in FIG. 23, the container (118) has a seat part (123) formed at a top thereof, and can be used as a chair. Furthermore, wheels can be provided under the legs (120) for conveying the container (118). The container can be provided with a handle at a side thereof for pulling the container. The legs (120) can be fastened by screws, and are adjustable in height to adapt to various performers and for reducing the size of container in conveying.

According to the specification as above, the elements of the analog electronic drum set of the invention only generate very low volume of sounds, so that the analog electronic drum can be used indoors for practice and will not disturb others nearby. Moreover, the elements have small sizes, which is convenient to convey the drum set and can save space for storing.

Moreover, the sounds generated by the beating actions of the performer can be completely reproduced with a large volume of sound approximate to the conventional drum set. Of course, the present invention will not be limited in the first original sound generator (100) formed like the conventional drum set, and other types of musical instruments can also be emulated by this means.

By the constructions as described above, the present invention can generate a low volume and does not need a sound arrester. The features of the conventional electronic drum set can be retained, but the time difference between the beating actions and the reproduced sounds is eliminated. Furthermore, the subtle changes in the techniques of the performer can be represented in the reproduced sounds.

Therefore, the present invention can eliminate the shortcomings of the conventional electronic drum set but retain their advantages.

What is claimed is:

1. An analog electronic drum set comprising:

a first tom-tom with a batter head with tensioned membranes without a resonator, of which a diameter is 6 inches (15.24 cm);

a second tom-tom of which a diameter is 8 inches (20.32 cm);

a third tom-tom of which a diameter is 10 inches (25.4 cm);

a bass drum with a horizontal batter head of which a diameter is 12–14 inches (30.48–35.56 cm);

a snare drum of which a diameter is 8 inches (20.32 cm), having a chain belt adjustably connected to the snare drum to selectively contact against the batter head;

a hi-hat cymbal, of which a diameter is 6–8 inches (15.24–20.32 cm), having a top disk made of a non-magnetic metal, and a bottom disk made of a magnetic metal, which has a spring around a shaft between the bottom and top disks to provide an elastic force to separate the top disk from the bottom disk;

a first cymbal, of which a diameter is 8–10 inches (20.32–25.4 cm), having a disk made of a non-magnetic metal;

a second cymbal, of which a diameter is 10–12 inches (25.4–30.48 cm), having a disk made of a non-magnetic metal;

a sympathetic magnetic piece of an arch shape and abutting inner surfaces of the respective batter heads with adjustable pressure, which is located in a range from an edge of the sympathetic magnetic piece towards a center of the respective batter head and is 20–45% of a radius of the respective batter head of all tom-toms, the bass drum, and the snare drum, and the sympathetic magnetic piece is made of a magnetic board material which is able to resonate easily with the vibrations of the batter head;

a sympathetic magnetic piece is connected with the cymbal by the adjusting bolt, and wherein the sympathetic magnetic piece is made of a magnetic board material which can resonate easily with the vibrations of the cymbal;

an augmented microphone, that electrically amplify the induced current from vibrations of the sympathetic magnetic piece, and distances to the sympathetic magnetic piece are adjustable, located at a position corresponding to that of the respective sympathetic magnetic piece;

a pedal assembly, which has a pulley to rotate towards a predetermined direction, and a foot pedal which denies the predetermined direction by stepping downward and is rotated by the pulley, and a drumstick mounted on the pulley at a side of the pedal to rotate toward the front and down direction along with the pulley to beat the horizontal batter head of the bass drum;

an augmented microphone, that electrically amplifies the induced current from vibrations of the bottom disk of the hi-hat cymbal made of a magnetic metal; and a mallet for hitting elements of the analog electronic drum set, being 39–45 cm in an overall length, and having a front beating portion with a diameter of 3.5–4 mm and a length of 8–10 mm, a rear portion with a diameter of 8–10 mm and a length of 23–35 cm, a middle portion between the front portion and the rear portion with a diameter spreads out gradually of 2–2.5 mm and a length of about 10–15 cm, and a mass of 12–18 g.

2. An analog electronic drum set comprising:

a tom-tom with a batter head with tensioned membranes;

a bass drum with a horizontal batter head which can be directly beaten by a foot;

a snare drum having a chain belt that can be adjusted to selectively contact against the batter head;

a hi-hat cymbal, which has a top disk made of a non-magnetic metal, and a bottom disk made of a magnetic metal, which has a spring around a shaft between the top disk and bottom disks to provide an elastic force to separate the top disk from the bottom disk;

a cymbal, made of a non-magnetic metal disk;

a sympathetic magnetic piece of an arch shape and abutting inner surfaces of the respective batter heads with adjustable pressure, which is located in a range from an edge of the sympathetic magnetic piece towards a center of the respective batter head are 20–45% of a radius of the respective batter head of all tom-toms, the bass drum, and the snare drum, and the sympathetic magnetic piece is made of a magnetic board material which can resonate easily with the vibrations of the batter head;

a sympathetic magnetic piece of an arch shape and is connected with the cymbal by the adjusting bolt, and the sympathetic magnetic piece is made of a magnetic board material which can resonate easily with the vibrations of the cymbal;

an augmented microphone, that electrically amplifies the induced current from vibrations of the sympathetic magnetic piece, and distances to the sympathetic magnetic piece are adjustable, with corresponding position to the respective sympathetic magnetic piece;

a pedal assembly, which has a pulley to rotate towards a predetermined direction, and a foot pedal which denies the predetermined direction by stepping downward and can be rotated by the pulley, and a drumstick mounted on the pulley at a side of the pedal to rotate toward the front and down directions along with the pulley to beat the horizontal batter head of the bass drum; and an augmented microphone, that electrically amplifies the induced current from vibrations of the bottom disk of the hi-hat cymbal made of a magnetic metal, and distance from the augmented microphone to under the bottom disk is adjustable, with corresponding position.

3. An element for an analog electronic drum set comprising:

a horizontal batter head with tensioned membranes without a resonator;

a sympathetic magnetic piece of an arch shape and abutting inner surfaces of the batter heads with adjustable pressure, which located in a range from an edge of the sympathetic magnetic piece towards a center of the batter head and is 20–45% of a radius of the batter head, and the sympathetic magnetic piece is made of a magnetic board material which can resonate easily with the vibrations of the batter head;

an augmented microphone, that electrically amplifies the induced current from vibrations of the sympathetic magnetic piece and located at a position corresponding to that of the sympathetic magnetic piece; and a pedal assembly, which has a pulley to rotate towards a predetermined direction, and a foot pedal which denies the predetermined direction by stepping downward and is able to be rotated by the pulley, and a drumstick mounted on the pulley at a side of the pedal to rotate toward the front and down directions along with the pulley to beat the horizontal batter head of the bass drum.

4. A drum element for an analog electronic drum set comprising:

a batter head with tensioned membranes;

a sympathetic magnetic piece of an arch shape and abutting inner surfaces of the batter heads with adjustable pressure, which is located in a range from an edge of the sympathetic magnetic piece towards a center of the respective batter head and is 20–45% of a radius of the batter head, and the sympathetic magnetic piece is made of a magnetic board material which can resonate easily with vibrations of the batter head; and an augmented microphone, that electrically amplifies the induced current from vibrations of the sympathetic magnetic pieces, with corresponding position to the sympathetic magnetic pieces.

5. A cymbal element for an analog electronic drum set comprising:

a cymbal made of a non-magnetic metal disk;

a sympathetic magnetic piece connected with the cymbal by an adjusting bolt, the sympathetic magnetic piece made of a magnetic board material which is able to resonate easily with the vibrations of the cymbal; and an augmented microphone, that electrically amplifies the induced current from vibrations of the sympathetic magnetic piece, the augmented microphone located at a position corresponding to that of the sympathetic magnetic piece.

6. A cymbal element for an analog electronic drum set comprising:

a cymbal having a top disk made of a non-magnetic metal, and a bottom disk made of a magnetic metal, the cymbal element having a spring around a shaft between the top disk and the bottom disk to provide an elastic force to separate the top disk from the bottom disk; and an augmented microphone, that electrically amplifies the induced current from vibrations of the bottom disk.

7. A drum element of a conventional drum which gained the sound collection structure of analog electronic drum, comprising:

a sympathetic magnetic piece of an arch shape and abutting inner surfaces of the batter heads with adjustable pressure, which is located in a range from an edge of the sympathetic magnetic piece towards a center of the respective batter head and is 20–45% of a radius of the batter head, and the sympathetic magnetic piece is made of a magnetic board material which is able to resonate easily with the vibrations of the batter head; and an augmented microphone, that electrically amplifies the induced current from vibrations of the sympathetic magnetic piece, the augmented microphone located at a position corresponding to that of the sympathetic magnetic pieces.

8. A cymbal element which gained the sound collection structure of analog electronic drum, comprising:

a sympathetic magnetic piece of an arch shape and connected with the cymbal by an adjusting bolt, and the sympathetic magnetic piece made of a magnetic board material which is able to resonate easily with the vibrations of the cymbal; and an augmented microphone, that electrically amplifies the induced current from vibrations of the sympathetic magnetic piece, located at a position corresponding to that of the sympathetic magnetic piece.

9. A hi-hat cymbal element which gained the sound collection structure of analog electronic drum, comprising a bottom hi-hat cymbal made of a magnetic metal; and an augmented microphone, that electrically amplifies the induced current from vibrations of the bottom hi-hat cymbal and located at a position corresponding to that of the hi-hat cymbal.

10. A sound collection technology for the conventional drum element, comprising:

a sympathetic magnetic piece of an arch shape and abutting inner surfaces of the batter heads with adjustable pressure, which is located in a range from an edge of the sympathetic magnetic piece towards a center of the respective batter head and is 20–45% of a radius of the batter head, and the sympathetic magnetic piece is made of a magnetic board material which is able to resonate easily with the vibrations of the batter head; and an augmented microphone, that electrically amplifies the induced current from vibrations of the sympathetic magnetic piece, and distances to the sympathetic magnetic piece are adjustable, the augmented microphone located at a position corresponding to that of the sympathetic magnetic pieces.

11. A sound collection technology for the conventional cymbal element, assembly comprising:

a sympathetic magnetic piece of an arch shape and connected with the cymbal by an adjusting bolt, and the sympathetic magnetic piece being made of a magnetic board material which is able to resonate easily with the vibrations of the cymbal; and an augmented microphone, that electrically amplifies the induced current from vibrations of the sympathetic magnetic piece, located at a position corresponding to that of the sympathetic magnetic piece.

12. A sound collection technology for the conventional hi-hat cymbal element comprising a bottom hi-hat cymbal made of a magnetic metal; and an augmented microphone, that electrically amplifies the induced current from vibrations of the bottom hi-hat cymbal the augmented microphone located at a position corresponding to that of the bottom hi-hat cymbal.

* * * * *